US006672038B2

(12) United States Patent
McGrane et al.

(10) Patent No.: US 6,672,038 B2
(45) Date of Patent: Jan. 6, 2004

(54) BAG MANIPULATING METHOD AND ASSEMBLY FOR A BAG FILLING STATION

(75) Inventors: Thomas W. McGrane, Green Bay, WI (US); Ronald R. Parsons, Oconto Falls, WI (US); Gerald L. Townsend, Wausaukee, WI (US); Stefan Schabel, Green Bay, WI (US)

(73) Assignee: OPTIMA Machinery Corporation, Green Bay, WI (US)

( * ) Notice: Subject to any disclaimer, the term of this patent is extended or adjusted under 35 U.S.C. 154(b) by 109 days.

(21) Appl. No.: 09/798,396

(22) Filed: Mar. 2, 2001

(65) Prior Publication Data

US 2002/0121073 A1 Sep. 5, 2002

(51) Int. Cl.[7] ..... B65B 43/14

(52) U.S. Cl. ..... 53/570; 53/284.7; 53/374.8; 53/386.1; 53/371.8; 53/250; 53/459; 53/571; 53/573; 53/564

(58) Field of Search ..... 53/570, 371.8, 53/571, 573, 564, 374.8, 386.1, 284.7, 250, 459

(56) References Cited

U.S. PATENT DOCUMENTS

| | | | | |
|---|---|---|---|---|
| 2,601,480 A | | 6/1952 | Williams | |
| 3,262,833 A | | 7/1966 | Zelnick | |
| 3,471,993 A | | 10/1969 | Monsees et al. | |
| 3,490,195 A | * | 1/1970 | Abramson | 53/459 |
| 3,501,893 A | * | 3/1970 | Peterson | 53/573 |
| 3,552,088 A | | 1/1971 | Niwa | |
| 3,657,055 A | | 4/1972 | Nichols | |
| 3,700,387 A | | 10/1972 | Moore et al. | |
| 3,903,674 A | | 9/1975 | Brusil | |
| 3,925,139 A | | 12/1975 | Simmons | |
| 3,949,536 A | | 4/1976 | Chevalier | |
| 3,998,449 A | | 12/1976 | Hornung | |
| 4,018,031 A | | 4/1977 | Smaw | |
| 4,018,434 A | | 4/1977 | Mitchell et al. | |
| 4,037,387 A | * | 7/1977 | Orikawa | 53/459 |
| 4,156,334 A | * | 5/1979 | Burgat et al. | 53/385.1 |
| 4,211,053 A | | 7/1980 | Niccolls | |
| 4,241,562 A | * | 12/1980 | Meyer | 53/438 |
| 4,248,032 A | | 2/1981 | Woods et al. | |
| 4,275,977 A | | 6/1981 | Joice | |
| 4,432,186 A | | 2/1984 | McGregor | |
| 4,457,124 A | * | 7/1984 | Hartmann | 53/512 |
| 4,490,962 A | | 1/1985 | Weis et al. | |
| 4,537,012 A | | 8/1985 | Groom et al. | |
| 4,643,412 A | | 2/1987 | Heina et al. | |
| 4,688,782 A | | 8/1987 | Browne | |
| 4,726,170 A | | 2/1988 | Sawa et al. | |
| 4,869,051 A | | 9/1989 | Shifley et al. | |
| 5,005,341 A | * | 4/1991 | Tetenborg | 53/570 |
| 5,024,042 A | * | 6/1991 | Meyer | 53/168 |

(List continued on next page.)

*Primary Examiner*—Rinaldi I. Rada
*Assistant Examiner*—Brian D. Nash
(74) *Attorney, Agent, or Firm*—Michael Best & Friedrich LLP

(57) ABSTRACT

A bag manipulating method and assembly including a pair of bag grippers that receive and grip opposing side edges of a bag positioned in a loading station. The bag grippers are movable in a plane substantially normal to a longitudinal axis of the loading station. The bag manipulating assembly also includes upper and lower bag spreader assemblies, each having a suction cup to apply suction to the bag and a spreader plate that is insertable into the bag and movable to spread apart the bag. Preferably, the bag grippers move toward each other in a plane substantially normal to the longitudinal axis while the bag is being spread apart to facilitate opening the bag. To facilitate closing and sealing the bag, the bag grippers move away from each other in a plane substantially normal to the longitudinal axis after the bag has been filled.

10 Claims, 16 Drawing Sheets

U.S. PATENT DOCUMENTS

| | | | | |
|---|---|---|---|---|
| 5,117,612 | A | | 6/1992 | Keim et al. |
| 5,119,615 | A | | 6/1992 | Kujubu et al. |
| 5,133,543 | A | | 7/1992 | Eitel et al. |
| 5,279,095 | A | | 1/1994 | Muller |
| 5,279,099 | A | | 1/1994 | Goodman et al. |
| 5,551,206 | A | | 9/1996 | Fukuda |
| 5,687,544 | A | | 11/1997 | Watabe et al. |
| 5,771,667 | A | * | 6/1998 | McGregor et al. ..... 53/469 |
| 5,787,681 | A | | 8/1998 | Papina et al. |
| 5,791,126 | A | | 8/1998 | Kammler et al. |
| 5,799,465 | A | | 9/1998 | Townsend |
| 5,836,136 | A | | 11/1998 | Highberger |
| 5,855,107 | A | | 1/1999 | Haffield |
| 5,878,553 | A | | 3/1999 | Schlosser |
| 5,970,688 | A | | 10/1999 | Nyiendo et al. |
| 5,988,626 | A | | 11/1999 | La Vos et al. |
| 6,003,289 | A | | 12/1999 | McGregor et al. |
| 6,044,628 | A | | 4/2000 | Katayama et al. |
| 6,134,864 | A | | 10/2000 | McGregor et al. |
| 6,318,052 | B1 | | 11/2001 | Kuhar |
| 6,401,439 | B1 | | 6/2002 | Tetenborg et al. |
| 6,443,443 | B1 | | 9/2002 | Hirth et al. |

* cited by examiner

VACUUM

VACUUM

Fig. 24
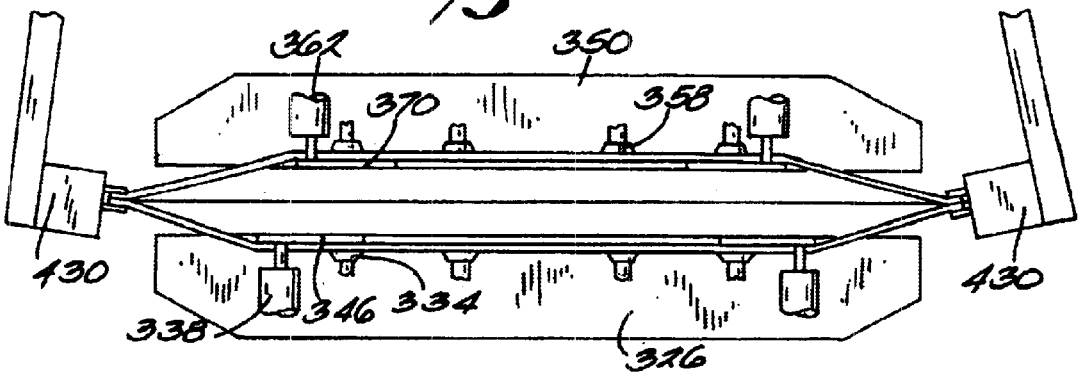
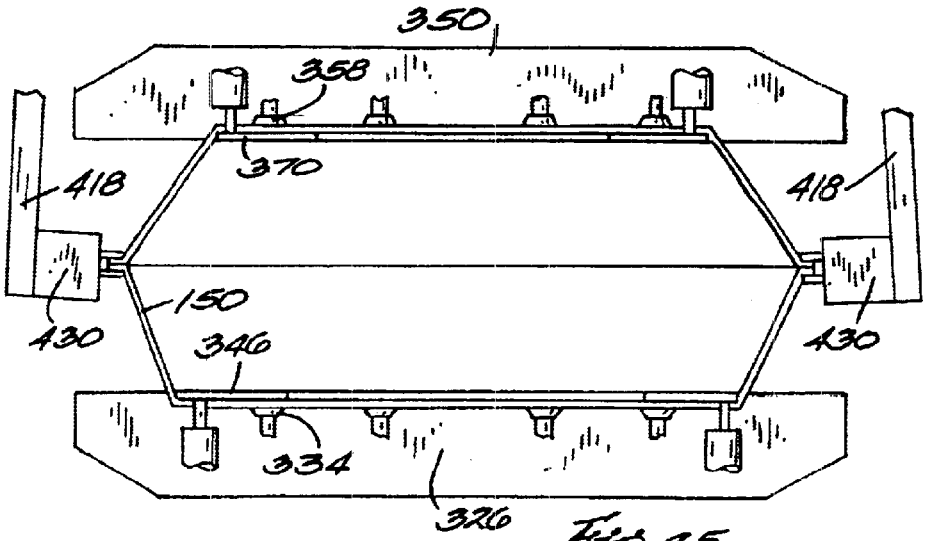
Fig. 25
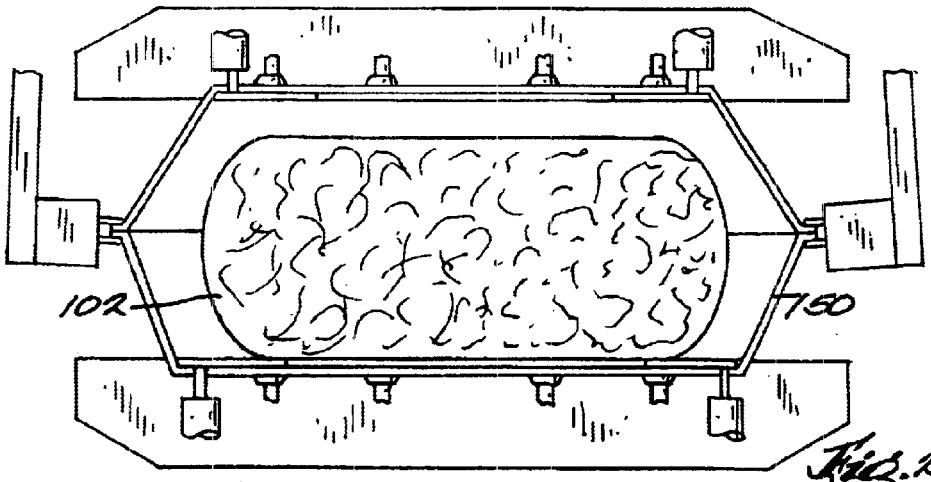
Fig. 26

BAG MANIPULATING METHOD AND ASSEMBLY FOR A BAG FILLING STATION

FIELD OF THE INVENTION

The invention relates to devices for opening, filling, and sealing plastic bags and other packaging. More particularly, the invention relates to automated devices that can produce an air-tight seal when packaging bulky products.

BACKGROUND OF THE INVENTION

Bag opening and filling devices have been developed for a wide variety of applications. Typically, these devices include one or more mechanisms for selecting a single bag from a stack of flattened, usually folded bags, and holding the selected bag open for filling. Prior-art devices commonly include a wicket that holds a stack of bags to be filled. Bags are torn from the wicket and opened prior to filling. Once the bag is opened, a pusher mechanism loads the product into the bag and a sealing mechanism seals the bag after the product has been loaded.

In modem packaging applications many different types of products are loaded into bags. It is difficult to obtain an air-tight or hermetic seal using available automated sealing equipment when packaging bulky products, such as diapers, sanitary napkins, paper napkins, and similar products. Fortunately, it is unnecessary to package these types of products in air-tight bags. However, there are applications that require hermetic sealing of the bag.

Packaging medical supplies is one such application. Hermetic sealing is required to ensure that the medical supplies are not contaminated after they are packaged and sealed in the bags. Attempts to automate the packaging and sealing of bulky medical supplies have been unsuccessful due to the problems associated with placing a bulky object in a flat bag and then attempting to bring the open edges of the bag together for sealing. The open edges wrinkle, which prevents the formation of a proper seal along the entire length of the bag opening. Consequently, bulky medical supplies are packaged and sealed by hand to ensure that a hermetic seal is produced. Manual packaging and sealing has several deficiencies. It is cumbersome, time-consuming, and vulnerable to human error.

SUMMARY OF THE INVENTION

Thus, there is a need for an automated packaging device that can be used to package medical supplies and other products in bags and to hermetically seal the bags. In addition, it would be beneficial if such a machine could monitor the quality of the seal. Further still, there is a need for a device where a relatively large number of bags can be loaded or otherwise provided to the packaging device so that product can be packaged at a relatively high rate without the need for replenishing the supply of bags at a similarly high rate.

In one embodiment, the invention provides an automated bag filling station or packaging device capable of rapidly packaging medical supplies and other bulky products in bags and sealing the bags in an air-tight manner. The packaging device includes a bag manipulating assembly for a bag filling device. The bag manipulating assembly includes a pair of bag grippers that receive and grip opposing side edges of a bag positioned in a loading station. The bag grippers are movable in a plane substantially normal to a longitudinal axis of the loading station. The bag manipulating assembly also includes upper and lower bag spreader assemblies, each having a suction cup to apply suction to the bag and a spreader plate that is insertable into the bag and movable to spread apart the bag.

In one aspect of the invention, the bag grippers move toward each other in a plane substantially normal to the longitudinal axis while the bag is being spread apart to facilitate opening the bag. To facilitate closing and sealing the bag, the bag grippers move away from each other in a plane substantially normal to the longitudinal axis after the bag has been filled.

In another embodiment, the invention provides a method of packaging an item in a bag using an automated packaging device. The method includes loading an open end of a bag into a loading station, gripping opposing sides of the bag with respective bag grippers as the bag is loaded into the loading station, opening the open end of the bag with a bag spreader assembly, loading the item into the bag with a package loading assembly, and sealing the open end of the bag with a welding assembly after the item has been loaded into the bag. Each of the bag grippers maintains the grip on the bag while the bag is opened, the item is loaded, and the open end is sealed so that control of the bag is maintained throughout the packaging process.

In one aspect of the invention, the bag grippers are moved toward one another, preferably via cam action or linear actuators, while the bag is being opened to facilitate opening the bag. To facilitate closing and sealing the bag, the bag grippers are moved away from one another after loading the item into the bag and before sealing the open end of the bag. This movement also preferably occurs via cam action or linear actuators.

Other features and advantages of the invention will become apparent to those skilled in the art upon review of the following detailed description, claims, and drawings.

BRIEF DESCRIPTION OF THE DRAWINGS

FIG. 10 is a perspective view of the loading station, the bag manipulating assembly, and a portion of a bag loading assembly loading a package into the opened bag.

FIGS. 21–28 sequentially illustrate, from the front, the opening, closing, and sealing of the bag.

Figure 1B:
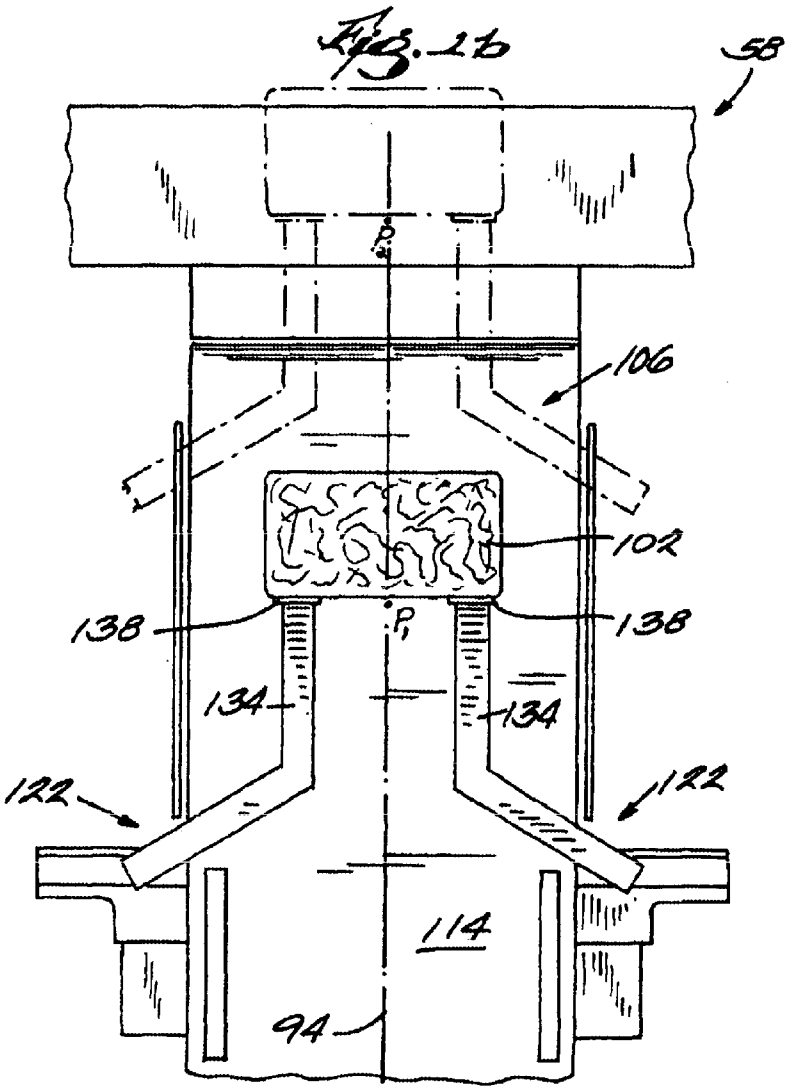
FIGS. 1*a* and 1*b* are top views of the package loading assembly in various operating states.

Before the invention is explained in detail, it is to be understood that the invention is not limited in its application to the details of construction and the arrangements of the components set forth in the following description or illustrated in the drawings. The invention is capable of multiple embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

Figure 1A:
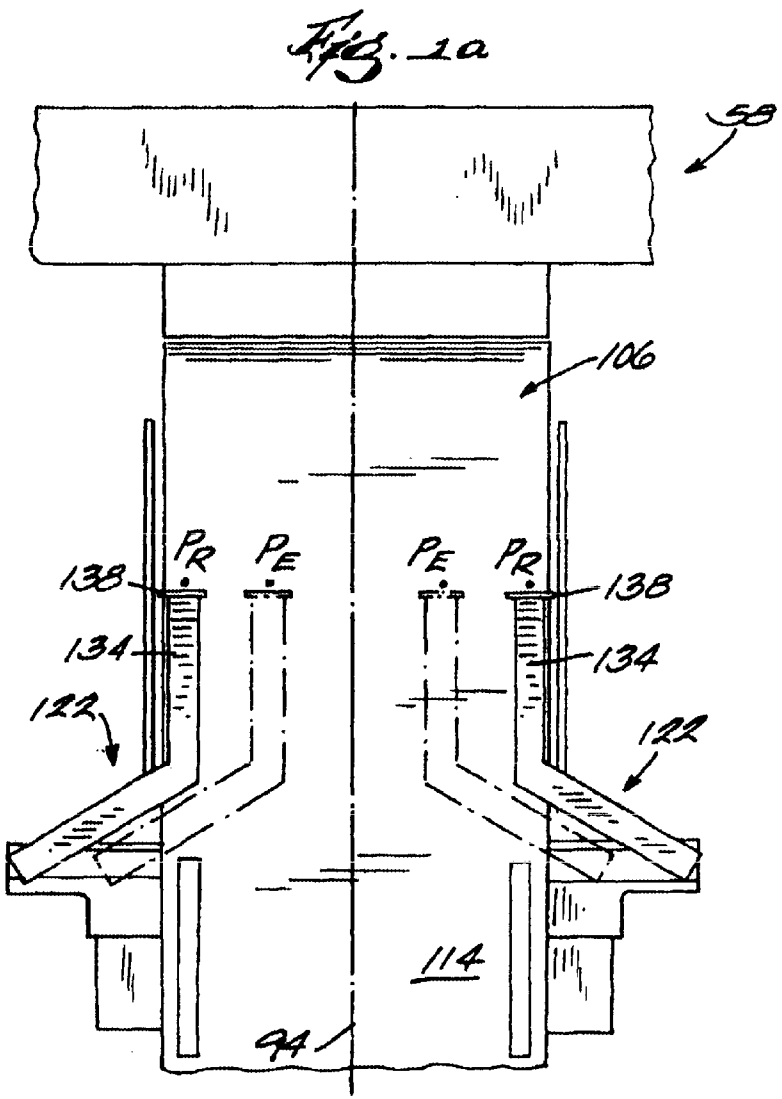
Figures 1, 2:
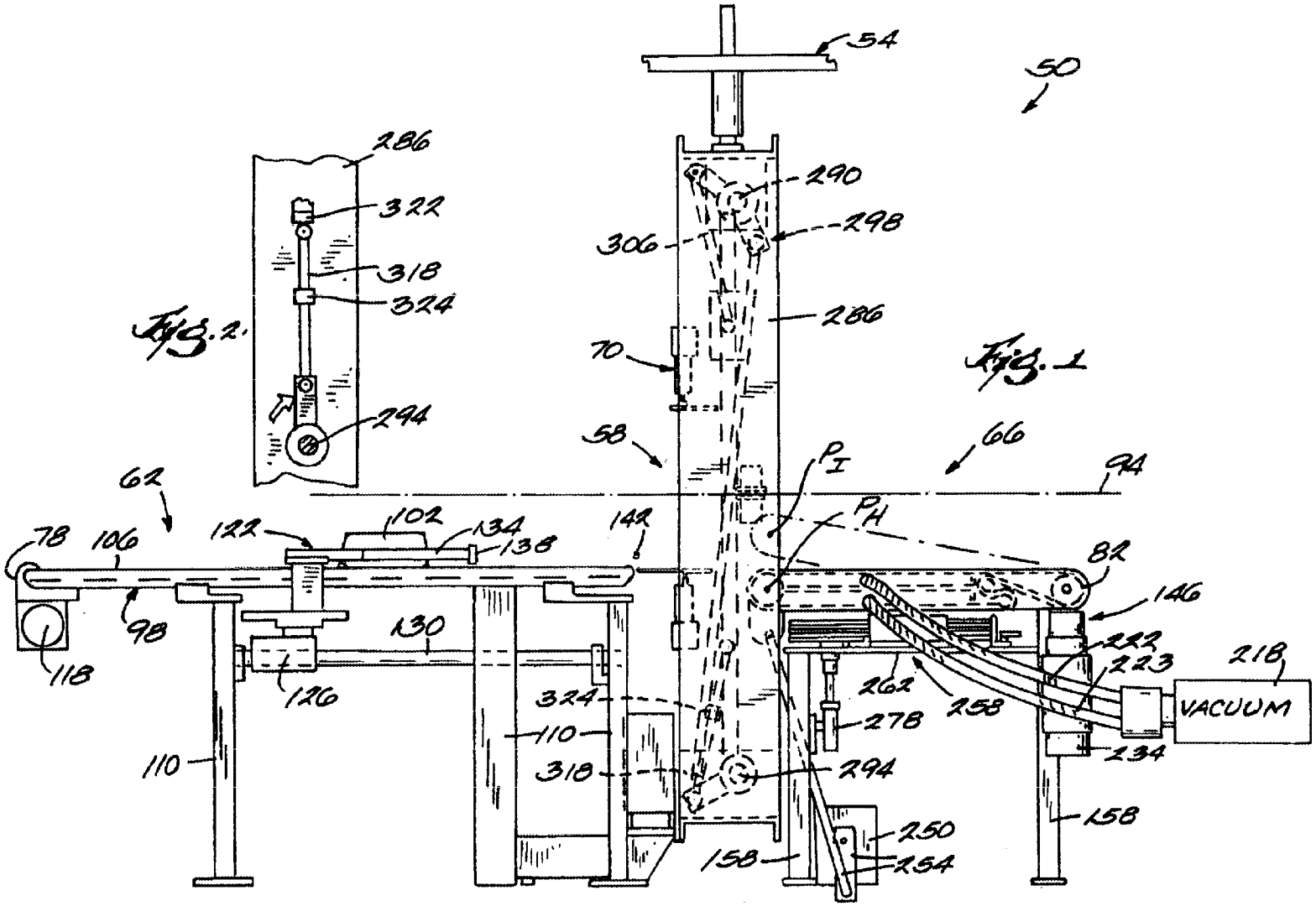
FIG. 1 is a side view of an automated packaging device embodying the invention.
FIG. 2 is an enlarged side view showing one of the support members of FIG. 1 in the package sealing position.

A bag filling station 50 of one embodiment is shown in FIG. 1. The bag filling station 50 includes a frame 54 (only partially shown) that supports the bag filling station 50. The frame 54 can also support protective walls (not shown) positioned around the bag filling station 50, as is commonly understood.

The bag filling station 50 includes a loading station 58 positioned within the frame 54, a package loading assembly 62 coupled to the frame 54 adjacent the loading station 58, a bag loading assembly 66 coupled to the frame 54 adjacent the loading station 58, a bag manipulating assembly 70 coupled to the frame 54 adjacent the loading station 58, and a bag welding assembly 74 (see FIG. 8) coupled to the frame 54 adjacent the loading station 58. For purposes of description only, the bag filling station 50 can be defined in terms of a front 78, adjacent the package loading assembly 62, a rear 82 adjacent the bag loading assembly 66, a right side 86, and a left side 90 (see FIG. 8). A longitudinal axis 94 (see FIGS. 1, 1*a*, 1*b*, 9, and 10) extends from the front 78 to the rear 82 through the loading station 58.

As seen in FIGS. 1, 1*a*, 1*b*, and 10, the package loading assembly 62 includes a package conveyor assembly 98 capable of transporting packages 102 to the loading station 58. The package conveyor assembly 98 includes a conveyor table 106 supported by support legs 110 (see FIG. 1). The conveyor table 106 includes an endless conveyor belt 114 (see FIG. 10) driven by a drive device 118 (see FIG. 1). A suitable conveyor table 106 is available from Domer Manufacturing of Hartland, Wis. The drive device 118 can be any suitable device capable of moving the conveyor belt 114, such as an electric motor.

The package conveyor assembly 98 also includes a pair of pusher arm assemblies 122 movably coupled to the conveyor table 106. The pusher arm assemblies 122 are substantially identical, and only one will be described. As seen in FIG. 1, the pusher arm assembly 122 includes a slide 126 mounted on a support member 130 for reciprocating linear movement in the direction of the longitudinal axis 94. The linear movement of the pusher arm assembly 122 is driven by any linear actuator (not shown) such as a hydraulic or pneumatic actuator, a rack and pinion system, and the like, or can be driven by the drive device 118.

The pusher arm assembly 122 also includes a pusher arm 134 having a pushing end 138 for pushing a package 102 into the loading station 58. As best seen in FIG. 1*a*, the pusher arm 134 is movable between a retracted position $P_R$ (shown in solid lines in FIG. 1*a*), where a package 102 can be advanced on the conveyor table 106 between the two pusher arms 134 toward the loading station 58, and an extended position $P_E$ (shown in phantom lines in FIG. 1*a*), where the two pusher arms 134 overlie the conveyor table 106. As shown in FIG. 1*b*, when in the extended position, the pusher arms move linearly from the position $P_1$ (shown in solid lines in FIG. 1*b*), to the position $P_2$ (shown in phantom lines in FIG. 1*b*) so that the pushing ends 138 can push the package 102 into the loading station 58.

Any suitable method of causing the movement of the pusher arms 134 between the retracted and extended positions can be used, including hydraulic or pneumatic actuators, rack and pinion systems, and the like. While the package conveyor assembly 98 preferably includes two pusher arm assemblies 122, it is understood that only one pusher arm assembly 122 could be used. Pusher arm assemblies having other configurations are also contemplated, including those shown in U.S. Pat. No. 5,799,465 incorporated by reference herein.

The package conveyor assembly 98 also preferably includes a sensor 142 (see FIG. 1) that senses the presence of a package 102 on the conveyor table 106 when the package 102 is adjacent the loading station 58. The sensor 142, which can be in the form of an optical sensor, a limit switch, or the like, communicates with the pusher arm assemblies 122 so that the pusher arm assemblies 122 are activated to push the package 102 when the package 102 is in position adjacent the loading station 58.

The package conveyor assembly 98 can also include guide rails 144 (see FIGS. 1*a* and 1*b*) on either side of the conveyor table 106 extending substantially parallel to the longitudinal axis 94 to help guide the package 102. The guide rails 144 can be adjustable to accommodate packages 102 of varying heights and widths.

Figure 3:
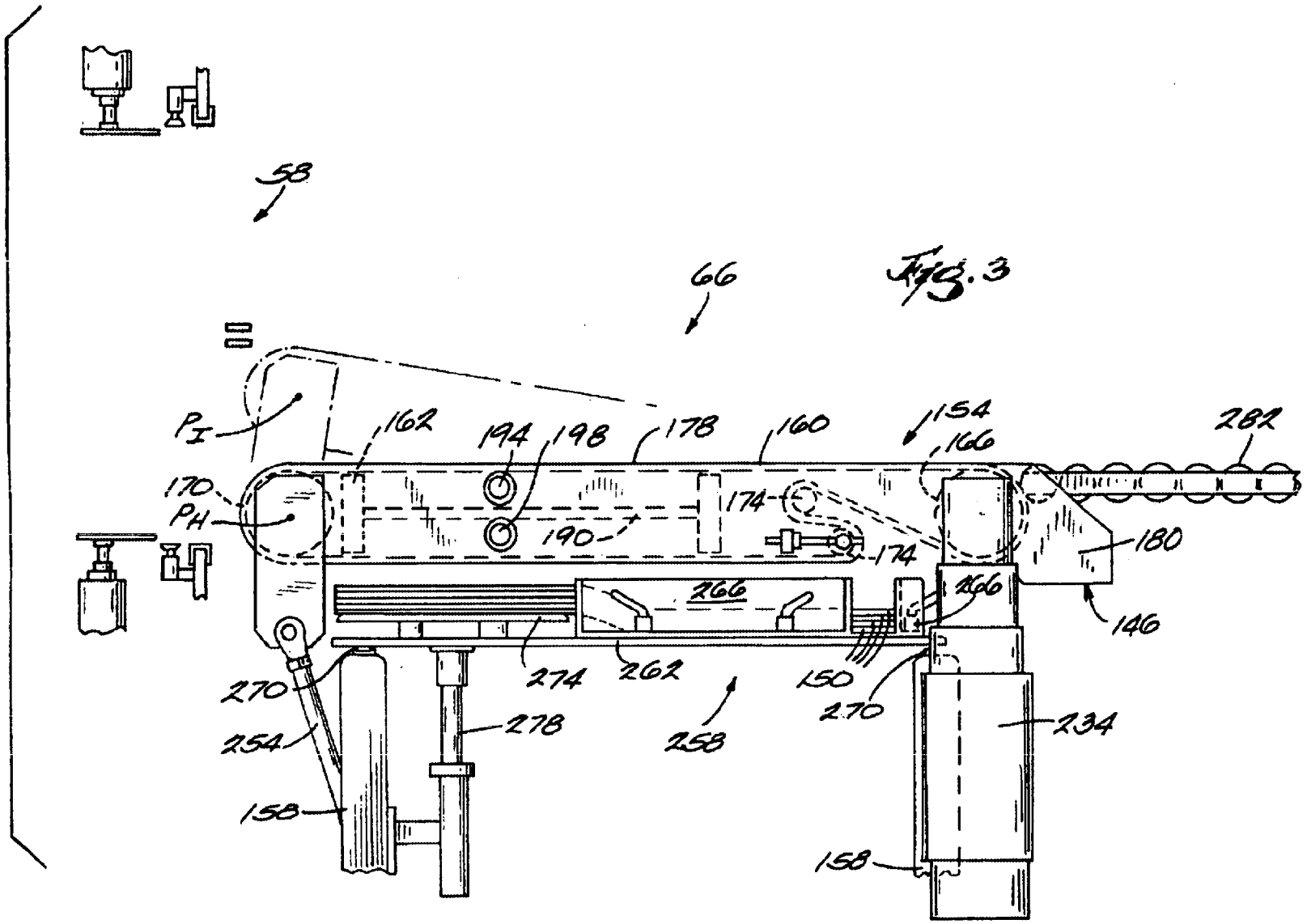
FIG. 3 is an enlarged side view showing the bag loading assembly of the device of FIG. 1.

As seen in FIGS. 1 and 3–7, the bag loading assembly 66 includes a bag feeder or bag conveyor assembly 146 capable of transporting a bag 150 to the loading station 58 for receiving a package 102. The bags have an open end for receiving the package 102. The bag conveyor assembly 146 includes a conveyor assembly 154 supported by support legs 158. As best seen in FIGS. 3–7, the conveyor assembly 154 includes a conveyor table 160 comprised of a body portion 162, a drive roller 166, a follower roller 170, a pair of tensioner rollers 174, an endless conveyor belt 178 encircling portions of the body portion 162 and the rollers 166, 170, and 174, and side supports 180 (only one is shown in FIG. 3).

The body portion 162 includes an upper cavity 182 and a lower cavity 186 separated by a wall 190. The wall 190 separates the cavities 182, 186 such that there is substantially no fluid communication between the cavities 182, 186. Upper and lower inlet ports 194 and 198, respectively (see FIG. 3), provide fluid communication to the cavities 182, 186 as will be described below. The body portion 162 further includes a top surface 202 having elongated apertures 206 communicating between the top surface 202 and the upper cavity 182. The body portion 162 also includes a bottom surface 210 having elongated apertures 214 that are preferably substantially identical to the apertures 206 and that communicate between the bottom surface 210 and the lower cavity 186. The body portion 162 has an overall width W (see FIG. 7).

Vacuum from a vacuum generator 218 (see FIG. 1) is applied to the body portion 162 through separate supply hoses 222 and 223. The upper supply hose 222 provides vacuum to the upper cavity 182 through the upper inlet port 194. The lower supply hose 223 provides vacuum to the lower cavity 186 through the lower inlet port 198. Of course, two separate vacuum generators could be used.

Figures 6, 7, 12:
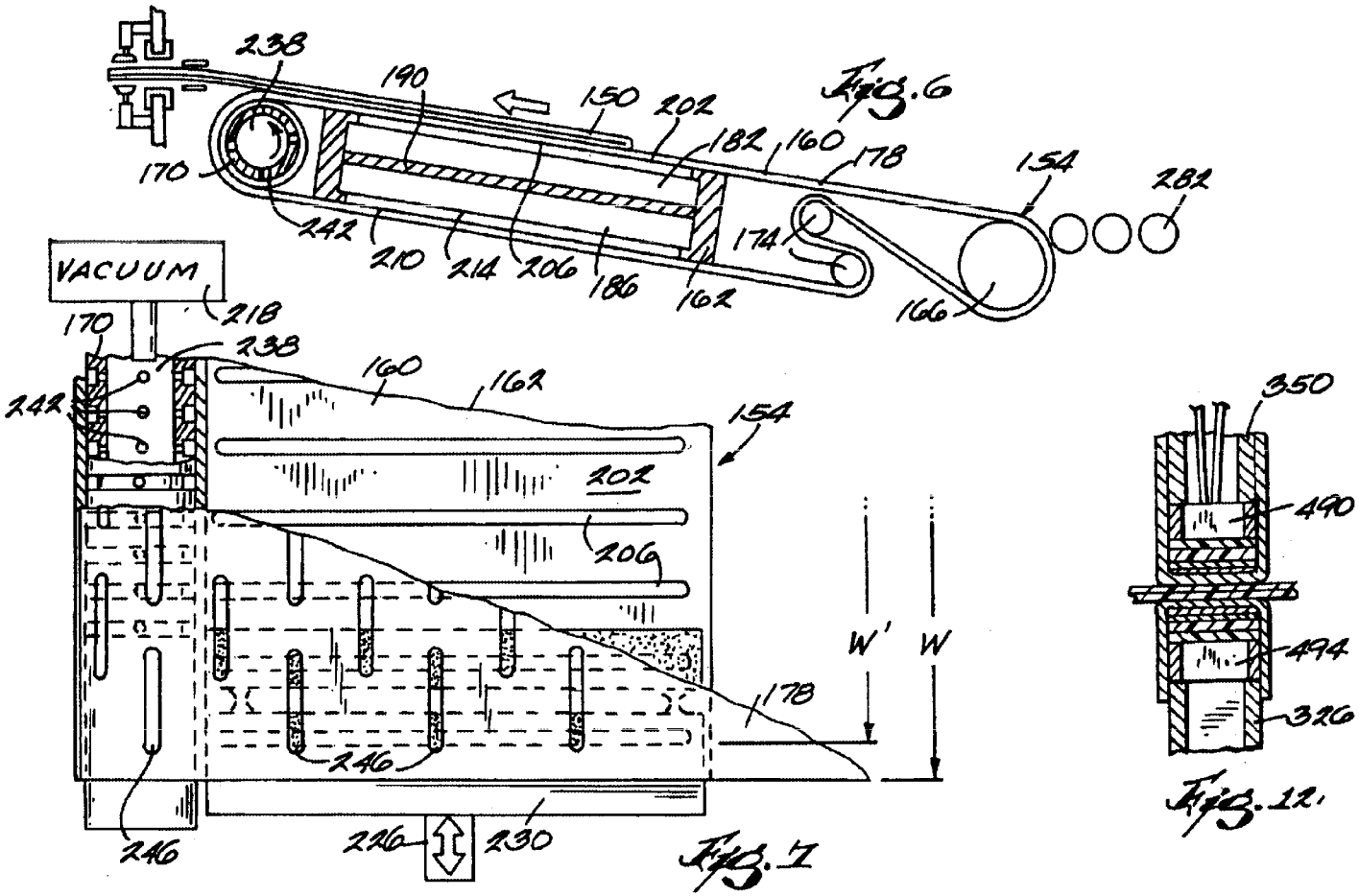
FIG. 7 is a partially cut away view of the conveyor assembly taken along line 7—7 in FIG. 4.
FIG. 12 is a sectional view of the welding jaws showing an alternative pressure sensor configuration.

The elongated apertures 206, 214 supply vacuum to the respective top and bottom surfaces 202, 210 over a working width W' (see FIG. 7). The working width W' of vacuum at the top and bottom surfaces 202, 210 is adjustable to accommodate the width of the bags 150 being used. In one embodiment, as shown in FIG. 7, a working width adjustment mechanism 226 is used to selectively block and unblock all or portions of some of the apertures 206, 214. To accomplish this, a pair of slide plates 230 (only the top slide plate is shown in FIG. 7) is moved to block and unblock the apertures, 206, 214. The slide plates 230 can be actuated manually or automatically.

The drive roller 166 is spaced from one end of the body portion 162, preferably in the rearward direction, and is supported for rotation between the side supports 180. A drive device 234 drives the drive roller 166. In one embodiment, the drive device 234 is an electric motor, and more preferably an electric motor that is programmed to actuate the drive roller 166 through a predetermined number of revolutions in either direction as will be described below. Alternatively, a standard electric motor could be used in conjunction with a sensing device (not shown) such as an optical sensor, a limit switch, or the like.

The follower roller 170 is spaced from the end of the body portion 162 opposite the drive roller 166, and is also supported for rotation between the side supports 180. The follower roller 170 preferably includes a cavity 238 that communicates with apertures 242 formed in the surface of the follower roller 170. A vacuum is applied to the follower roller 170 as shown schematically in FIG. 7. The vacuum generator 218 or a separate vacuum generator (not shown) is used to supply vacuum to the follower roller 170. It should be understood, however, that the follower roller 170 need not be configured to provide vacuum.

The endless conveyor belt 178 encircles the rollers 166, 170 such that there is always a portion of the conveyor belt 178 engaging both the top surface 202 and the bottom surface 210. The tensioner rollers 174 are supported for rotation between the side supports 180 as shown in FIG. 3, and at least one of the tensioner rollers 174 is movable to adjust the tension in the conveyor belt 178 as is understood. Of course other arrangements can be used to adjust the tension of the conveyor belt 178.

As seen in FIG. 7, the conveyor belt 178 includes a plurality of transverse apertures 246 that provide communication between the outer surface of the conveyor belt 178 and the respective top and bottom surfaces 202, 210 so that the vacuum supplied from the vacuum generator 218 to the body portion 162 can communicate with the outer surface of the conveyor belt 178. In the illustrated embodiment, each transverse aperture 246 communicates with two apertures 206 when adjacent the top surface 202 and two apertures 214 when adjacent the bottom surface 210. The transverse apertures 246 also communicate with the apertures 242 in the follower roller 170 so that a vacuum is also applied to the outer surface of the conveyor belt 178 as the conveyor belt 178 passes over the follower roller 170.

Although it is preferable to use vacuum, the conveyor table 160 need not be configured to supply vacuum to the conveyor belt 178. Rather, the conveyor table 160 could use other suitable techniques, such as static attraction, to engage and manipulate the bags 150 in the manner discussed below.

The conveyor table 160 is pivotable about the axis of rotation of the drive roller 166 between a first, substantially horizontal position $P_H$ (as shown in solid lines in FIGS. 1 and 3), and a second, inclined position $P_I$ (as shown in phantom lines in FIGS. 1 and 3). The purpose of this movement will be described below. A drive device 250 (see FIG. 1) is connected via linkage members 254 to one or both of the side supports 180 adjacent the follower roller 170 as shown. Activation of the drive device 250 moves the linkage members 254 to move the conveyor table 160 between the first and second positions $P_H$, $P_I$. Of course, other methods of moving the conveyor table 160 between the first and second positions, such as the use of actuators, rack and pinion systems, and the like, are also contemplated.

As best seen in FIGS. 1 and 3, the bag conveyor assembly 146 also includes a bag holder or cartridge tray assembly 258 underneath the conveyor table 160 for holding a stack of bags 150. A bag tray 262 is supported by the support legs 158 and receives a stack of bags 150 which are positioned between guide walls 266 (only two are shown in FIGS. 1 and 3). To facilitate replacing the stack of bags 150 in the bag tray 262, the bag tray 262 is preferably mounted on rollers 270 (see FIG. 3) and can be rolled out from underneath the conveyor table 160.

As best seen in FIG. 3, a lifting plate 274 inside the bag tray 262 is connected to a lifting mechanism 278 that is fixed to one of the support legs 158.

The lifting mechanism can be an actuator, a rack and pinion system, or the like. As will be described below, the lifting mechanism 278 is actuated to move the lifting plate 274 to raise or lower the stack of bags 150 with respect to the bottom of the bag tray 262.

The conveyor assembly 154 can also include a take-off conveyor 282 (see FIGS. 3–7) for receiving filled bags 150 as they exit the conveyor table 160. The take-off conveyor 282 acts as a bridge between the conveyor table 160 and a permanent conveyor (not shown) that transports the filled bags 150 to an off-loading point. Of course, the take-off conveyor 282 can be eliminated if the permanent conveyor is arranged adjacent the drive roller 166 of the conveyor table 160.

The loading station 58 is positioned between the package loading assembly 62 and the bag loading assembly 66 and is best seen in FIGS. 1 and 8–10. The frame 54 includes a substantially rectangular support section 286 (see FIGS. 1 and 8) which substantially surrounds the loading station 58 and which supports the bag manipulating assembly 70 and the bag welding assembly 74. Upper and lower transverse shafts 290 and 294, respectively, are supported for rotation by the support section 286 and are coupled together via linkages 298. A drive device 302 (see FIG. 8) is coupled to the lower shaft 294 and selectively rotates the lower shaft 294 in either direction. When the lower shaft 294 is rotated, the linkages 298 cause rotation of the upper shaft 290.

Figure 8:
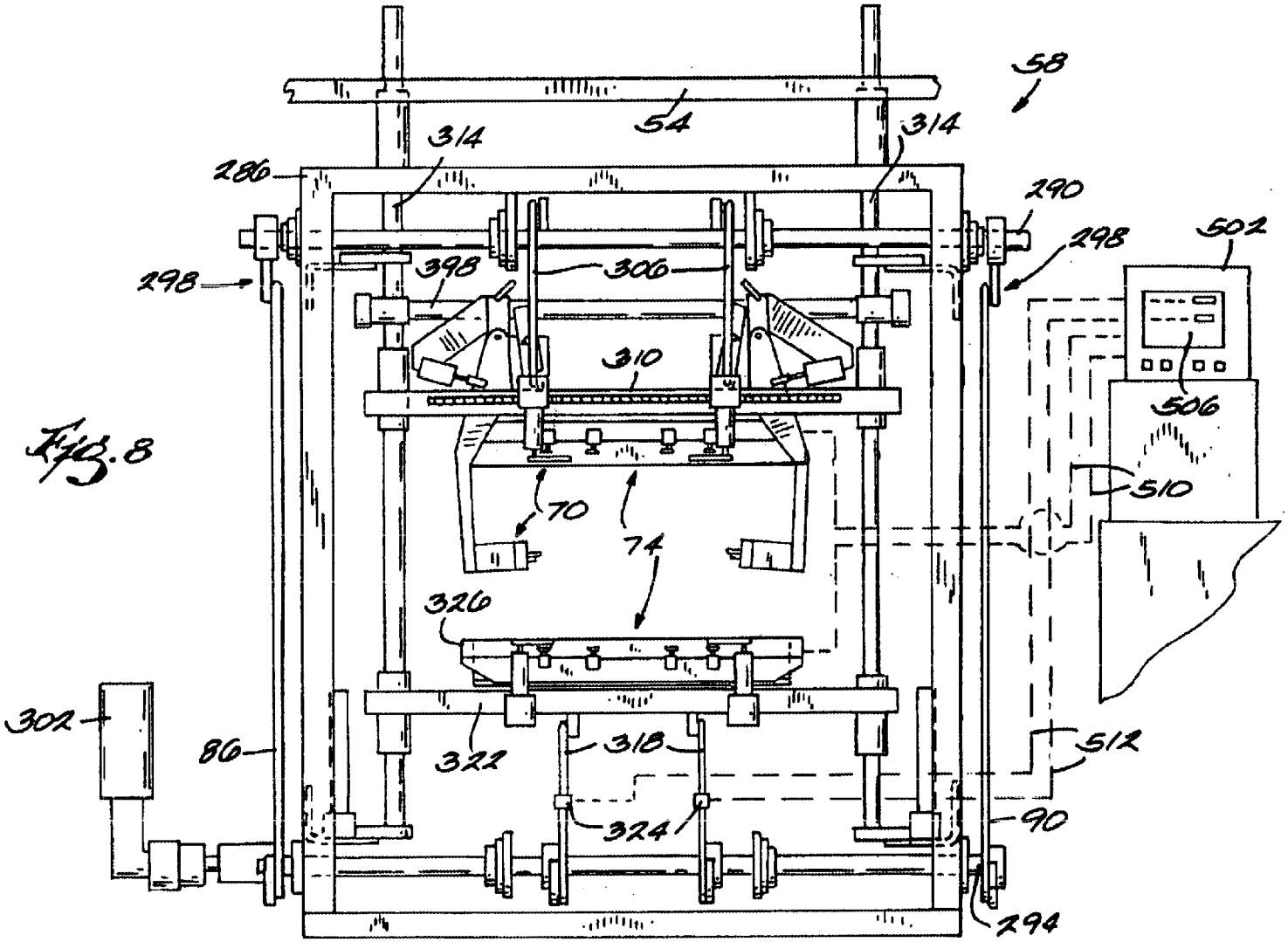
FIG. 8 is a front view showing a loading station, a bag manipulating assembly, and a bag welding assembly of the device of FIG. 1.

A pair of upper support members or struts 306 are mounted to the upper shaft 290 and connect the upper shaft 290 to an upper jaw support member 310 (see FIG. 8). The upper jaw support member 310 is movably supported on substantially vertical guide rails 314 within the frame support section 286.

Rotation of the upper shaft 290 causes vertical movement of the upper jaw support member 310, as will be described below.

Likewise, a pair of lower support members or struts 318 are mounted on the lower shaft 294 and connect the lower shaft 294 to a lower jaw support member 322. The lower jaw support member 322 is movably supported on the guide rails 314. Rotation of the lower shaft 294 causes vertical movement of the lower jaw support member 322, as will be described below, Each of the lower struts 318 has mounted thereon a pressure measurement device or sensor 324. The pressure sensor 324 is preferably a load cell. For reasons to be explained in more detail below, the lower struts 318 are sized so that as the lower jaw support member 322 reaches its uppermost vertical limit, the struts 318 are oriented substantially vertically as shown in FIG. 2. If the range of motion of the lower jaw support member 322 is varied for different applications, the struts 318 can be adjusted so that the struts 318 will always be substantially vertical when the lower jaw support member 322 reaches the uppermost vertical limit.

Figure 9:
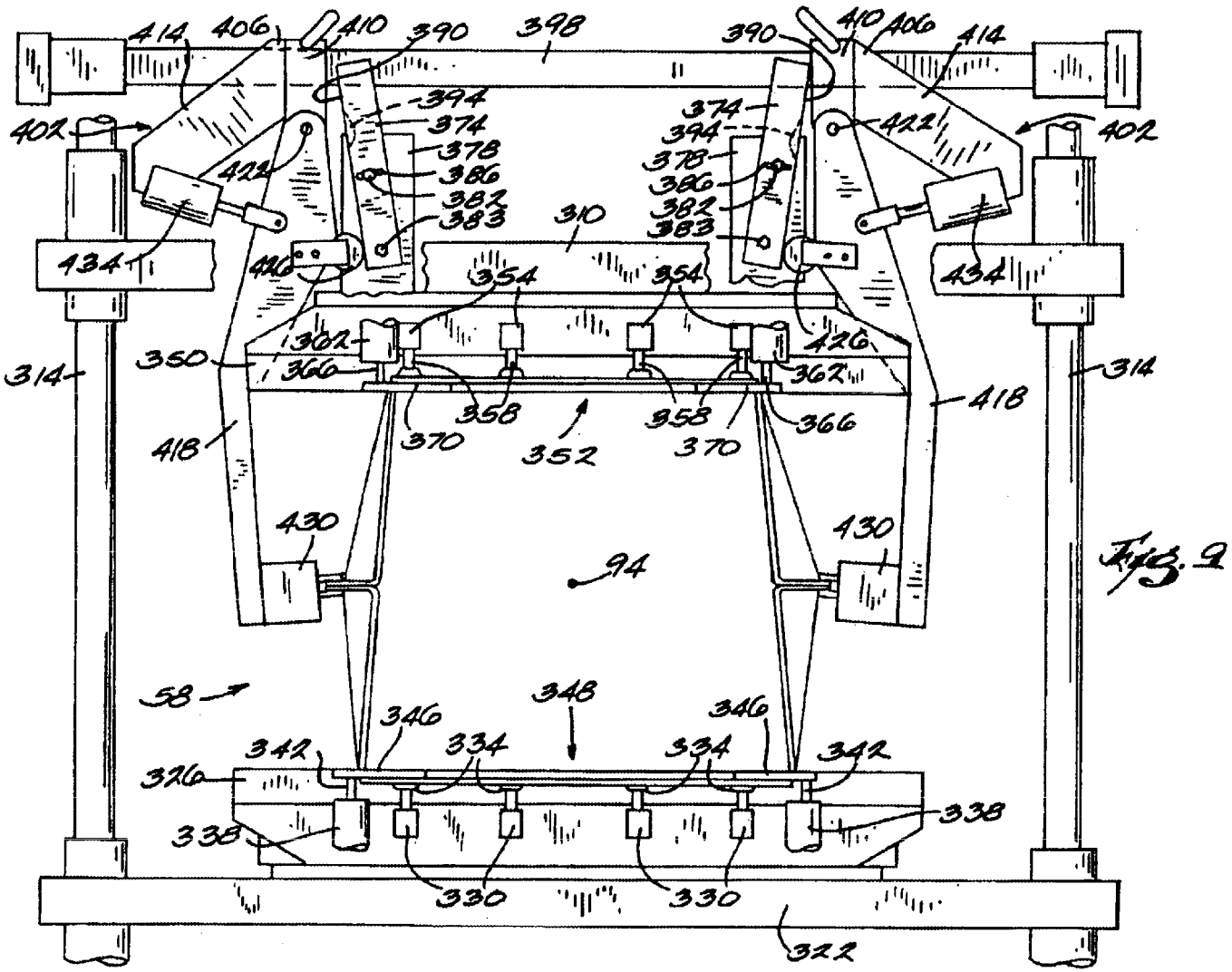
FIG. 9 is an enlarged front view of the loading station and the bag manipulating assembly shown with a bag opened for receiving a package.

The upper and lowerjaw support members 310, 322 support portions of the bag manipulating assembly 70 and the bag welding assembly 74. As best seen in FIG. 9, the lower jaw support member 322 supports a lower welding jaw 326, which will be described in more detail below. A plurality of suction cup assemblies 330 are mounted in spaced relation on a front face of the lower welding jaw 326. Each suction cup assembly 330 is connected to a vacuum supply and can selectively apply suction via a suction cup 334. As will be described below, the suction cup assemblies 330 are used to engage an open end of the bag 150.

A pair of rotary actuators 338 are also mounted on the lower jaw support member 322. Each rotary actuator includes a pin 342 that can be both rotated and translated with respect to the housing of the rotary actuator 338, as is understood. A spreader plate 346 is mounted on the pin 342 of each rotary actuator 338. The purpose of the spreader plate 346 will be described below. Together, the suction cup assemblies 330, the rotary actuators 338, and the spreader plates 346 define a lower bag spreader assembly 348.

The upper jaw support member 310 supports an upper welding jaw 350 and a substantially identical upper bag spreader assembly 352 in opposing relation to the lower bag spreader assembly 348. The upper bag spreader assembly 352 includes suction cup assemblies 354 having suction cups 358, and a pair of rotary actuators 362. Each rotary actuator 362 has a pin 366 and a spreader plate 370 mounted on the pin 366.

Additionally, the upperjaw support member 310 includes a pair of cam members 374 adjustably mounted to mounting plates 378. The cam members 374 are substantially identical and only one will be described. Each cam member 374 is fastened to one mounting plate 378 via upper and lower fasteners 382 and 383. The upper fastener 382 is received in a slot 386 in the cam member 374 such that the cam member 374 is pivotally adjustable about the lower fastener 383. The cam member 374 further includes a cam surface 390 corresponding to an edge of the cam member 374. Adjustment of the cam member 374 changes the angle of the cam surface 390. The cam surface 390 can include an optional dwell point 394 (shown in phantom in FIG. 9), which will be described below.

The cam members 374 cooperate with another portion of the bag manipulating assembly 70. As best seen in FIGS. 8 and 9, a support beam 398 is fixedly supported between the guide rails 314. Unlike the upper and lower jaw support members 310, 322, the support beam 398 is not free to move vertically along the guide rails 314. A pair of gripper arm assemblies 402 (see FIG. 9) are mounted on the support beam 398 in spaced-apart, opposing relation. The gripper arm assemblies 402 are substantially identical, and only one will be described in detail.

Each gripper arm assembly 402 includes a bracket member 406 having a base portion 410 and an arm portion 414. A gripper arm 418 is pivotally connected to the base portion 410 at pivot point 422. A cam follower 426 is mounted to the gripper arm 418 and engages the cam surface 390. In the illustrated embodiment, the cam follower 426 is a roller. A linear actuator or gripper 430 is mounted on the end of the gripper arm 418 for gripping the side edges of a bag 150, as will be described below. The gripper 430 is preferably a pneumatically-actuated, parallel gripper.

With continuing reference to FIG. 9, as the upper jaw support member 310 moves downwardly, the cam followers 426 roll on the cam surfaces 390 and the gripper arms 418 pivot about the pivot points 422 in a plane substantially normal to the longitudinal axis 94. Downward movement of the upper jaw support member 310 causes the gripper arms 418 and the grippers 430, to move away from one another. As the upperjaw support member 310 moves upwardly, the gripper arms 418 and the grippers 430 move back toward each other in a plane substantially normal to the longitudinal axis 94. The dwell points 394 in the cam surfaces 390 are designed to change the cam surfaces 390 so that the pivot arms 418 will not pivot during certain points of the operation of the bag filling station 50, as will be described below.

On both gripper arm assemblies 402, a linear actuator 434 is connected between the arm portion 414 and the gripper arm 418. Together, the linear actuators 434 are operable to pivot the gripper arms 418 even further away from one another than would otherwise occur via the normal movement of the cam followers 426 along the cam surfaces 390. The linear actuators 434 are preferably short-stroke pneumatic actuators. As will be described below, the linear actuators 434 are preferably actuated just prior to the sealing of the bag 150 when the upper jaw support member 310 is at its lowermost vertical limit.

Figure 11:
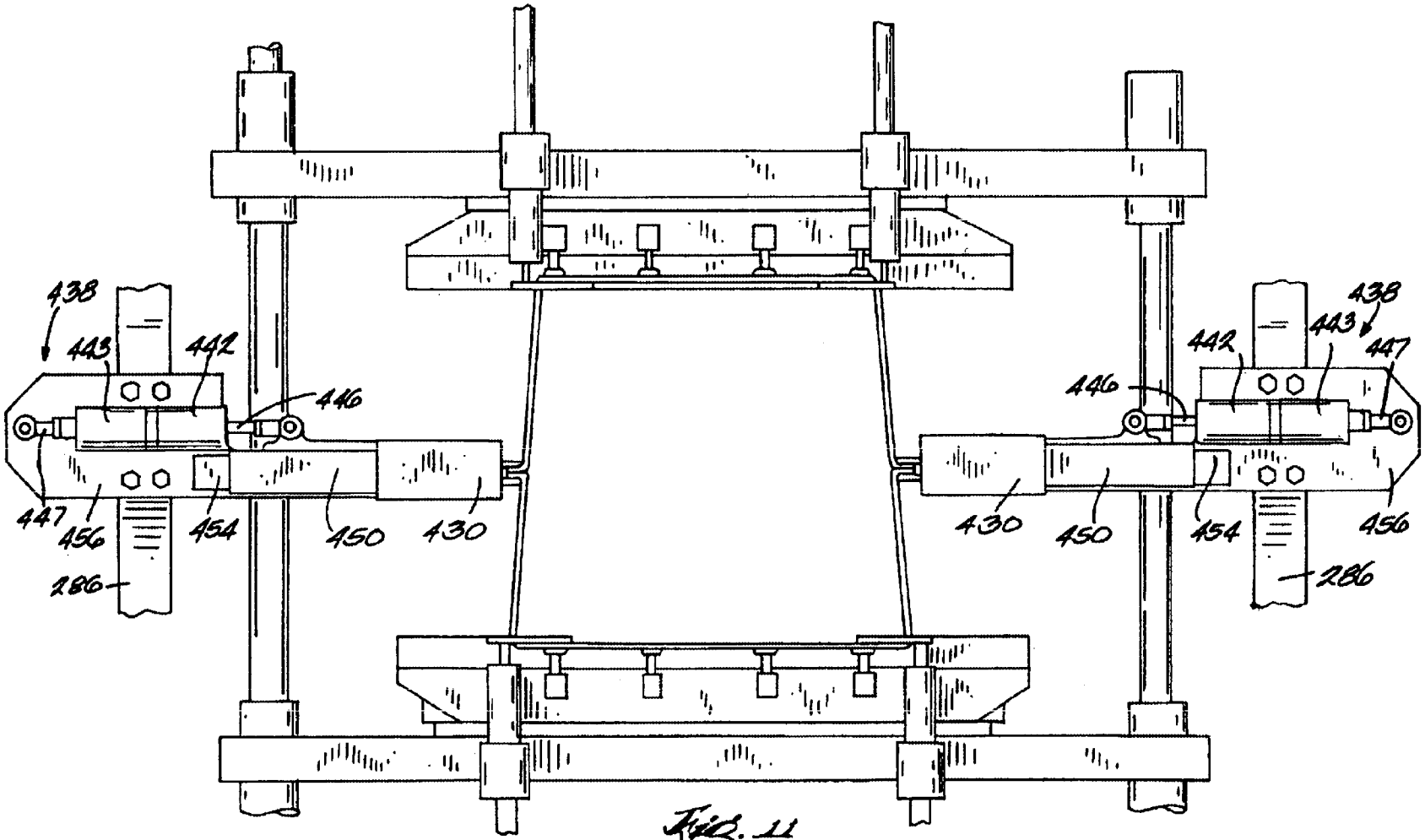
FIG. 11 is an alternative gripper arrangement that can be used with the bag manipulating assembly.

FIG. 11 illustrates a pair of alternative gripper assemblies 438 that can be used in place of the gripper arm assemblies 402. Instead of the cam action used to pivot the gripper arm assemblies 402, the alternative gripper assemblies 438 are fixedly mounted to the opposing vertical members of the frame support section 286, and are linearly actuated to move the grippers 430 toward or away from each other. The gripper assemblies 438 are substantially identical and include back-to-back cylinders 442, 443 having respective rods 446, 447.

The rod 446 is connected to a sliding portion 450 which slides on a guide rail 454. Actuation of the cylinder 442 moves the rod 446 and causes movement of the sliding portion 450. The rod 447 is connected to a body portion 456 that is fixed with respect to the frame support section 286. Actuation of the cylinder 443 causes the cylinders 442 and 443 to move with respect to the body portion 456, thereby causing movement of the sliding portion 450. The gripper 430 is mounted on the sliding portion 450 so that actuation of either of the cylinders 442, 443 causes the grippers 430 to move toward or away from one another.

The components of the bag manipulating assembly 70 operate to receive the bag 150 from the bag loading assembly 66, open the open end of a bag 150 so that the package 102 can be inserted, and close the open end of the bag 150 once the package 102 has been inserted. The bag 150 is closed in a manner that is conducive to obtaining a quality seal of the open end of the bag 150. The bag 150 is under the control of the bag manipulating assembly 70 from the time it is received to the time it is removed from the loading station 58.

Figure 13:
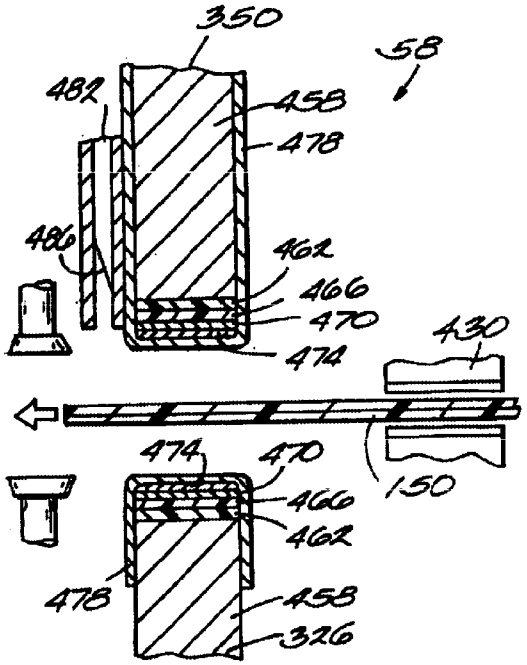
Figure 17:
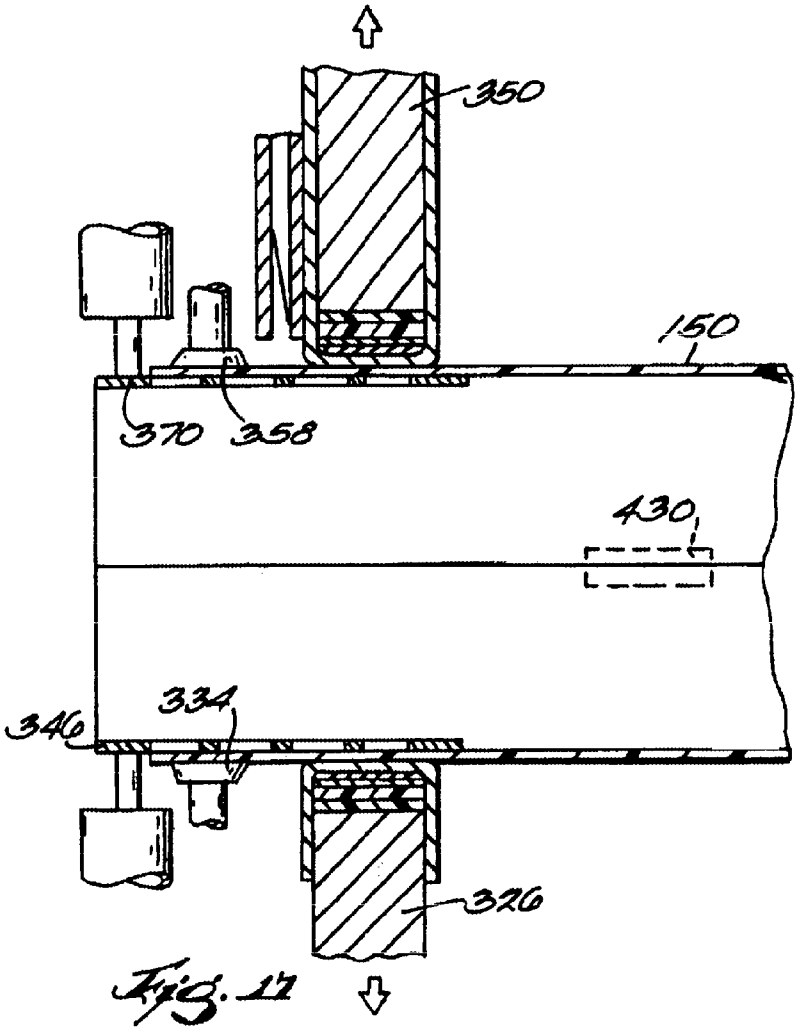

The bag welding assembly 74 is used to weld or seal the open end of the bag 150 after the package 102 has been inserted. The welding assembly 74 includes the upper and lower welding jaws 350, 326 and the associated hardware which are available from TOSS Machine Components Inc. of Nazareth, Pa. As seen in FIG. 13, in one embodiment, each of the welding jaws 326, 350 includes a body portion 458, a fiberglass strip 462, a silicon strip 466, a teflon strip 470, and a weld wire 474. A layer of teflon tape 478 surrounds the working ends of the welding jaws 326, 350. Of course, welding could be accomplished with only one of the welding jaws 326, 350 having a weld wire 474.

The upper welding jaw 350 can also include a cutter assembly 482 that trims off a portion of the bag 150 after the open end has been sealed. The cutter assembly 482 can include a knife edge 486 that extends to trim the bag 150 when the welding jaws 326, 350 are closed. Of course, other cutter assembly configurations can be used. For example, a welding jaw having a sealing wire that simultaneously seals and cuts the bag 150 could also be used.

The welding assembly 74 also includes the pressure measurement devices 324 mounted on the lower struts 318. The pressure measurement devices are used to measure the pressure between the welding jaws 326, 350 while the bag 150 is sealed. Recall that as the lower welding jaw 326 reaches its uppermost vertical limit (i.e., the position where the welding takes place), the lower struts 318 are substantially vertical. This orientation promotes accurate measuring of the welding pressure because the pressure measurement devices 324 are in axial alignment with the forces exerted on the lower welding jaw 326 by the upper welding jaw 350.

FIG. 12 illustrates an alternative arrangement for the pressure measuring device. In FIG. 12, a pressure measurement device 490 (i.e., a load cell or the like) is mounted in a recess in the upper welding jaw 350. A contact disk 494 is mounted in a recess in the lower welding jaw 326. Multiple sets of devices 490 and disks 494 can be spaced along the length of the welding jaws 326, 350 as desired.

Regardless of the pressure measuring arrangement used, the pressure measuring devices 324, 490 are used to monitor the quality of the seal that is created by the welding jaws 326, 350, as will be described below. Verifying the formation of a quality seal without human intervention, and being able to document and record the process for future reference is an advantage of the bag filling station 50. The bags 150 are sealed using heat to melt the open end of the bag 150 together, as is understood. At least three components are important to achieve a good seal: pressure, temperature, and time. The bag filling station 50 monitors these three components so that the quality of the seal can be validated, which is especially important when packaging medical devices.

Time is the easiest to control, and refers to the time the pressure and heat are applied during the sealing process. Temperature is more difficult to control and measure, but suitable products are available. Pressure is applied using the drive device 302, such as an electric motor. Controlling the pressure entails controlling the current in the electric motor. Alternatively, pressure could be controlled via an air-cylinder (not shown). Pressure is measured using the pressure measurement devices 324, as described below.

During the sealing process, the weld wires 474 are heated to a temperature set by a controller or processor 502. The processor 502 is preferably a programmable logic control device and can have a video display 506. The temperature is held for a predetermined time dictated by the processor 502. The actual temperature of the weld wires 474 is monitored and temperature signals are sent to the processor 502 via signal lines 510. The actual temperature is compared to predetermined temperature settings.

When the heat command is removed, the welding seam is allowed to cool and pressure is applied for a time specified by the processor 502. As seen in FIG. 8, the pressure measuring devices 324 are linked to the processor 502 via lines 512. The processor 502 analyzes the signals from the pressure measurement devices 324 and determines the actual welding pressure applied. In one embodiment, the measured pressure, heat, and time values are displayed on the video display 506 and are compared to predetermined values to determine the quality of the seal. Additionally, two or more pressure measurements (corresponding to the number of pressure measurement devices 324 or 490 used) are compared to one another to determine the consistency of the seal along the length of the welding jaws 326, 350. With this approach, inconsistent or incomplete sealing caused by debris between the welding jaws 326, 350 or wrinkles in the bag 150 can be detected.

The processor 502 reads and records the pressure and temperature data at a predetermined sampling rate that allows the process to be validated. Each seal has data associated with it that the seal was heated to a certain temperature and that a certain pressure was maintained for a certain time. If any of the data indicates that improper sealing conditions were present, the sealed bag is rejected. While not shown, the bag filling station 50 can also include a marking device that can be used to catalog the sealed bags by placing some form of indicating feature (i.e., a serial number, a bar code, or the like) on the bags that is linked to the weld data. When the bags are marked with an indicating feature, the seal quality of any bag can be verified at a later time.

Figure 4:
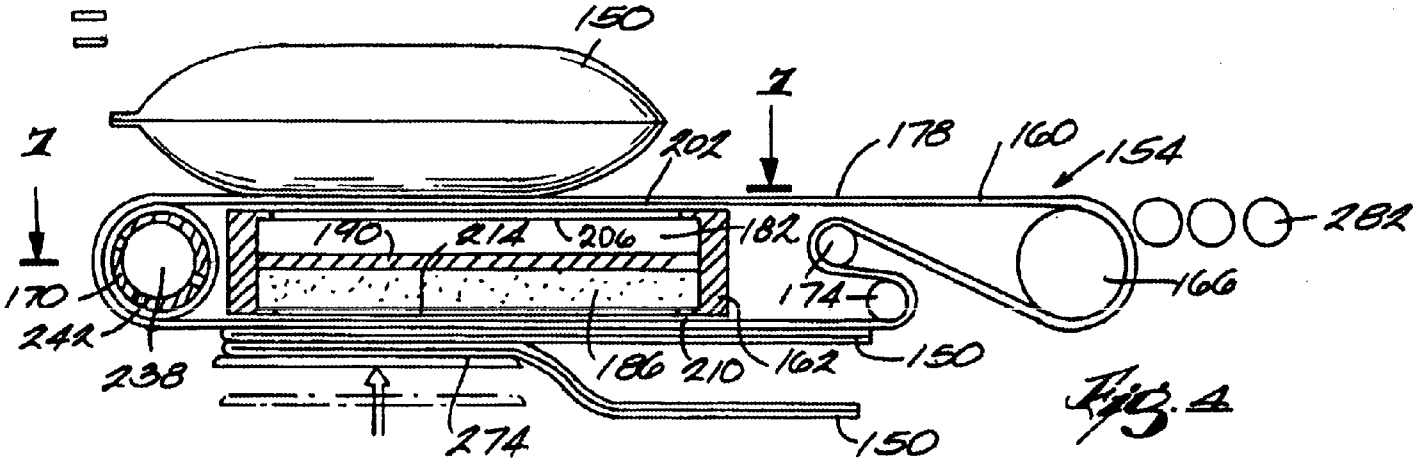
FIGS. 4–6 are side views of the conveyor assembly portion of the bag loading assembly of FIG. 3 shown in various operational states.

The operation of the bag filling station 50 will now be described. The bags 150 are first stacked in the bag tray 262 so that the open ends are to the right as viewed in FIG. 3. The bag tray 262 is then slid into place underneath the conveyor table 160. With the conveyor table 160 in the substantially horizontal first position $P_H$, the lifting mechanism 278 is actuated to lift the stack of bags 150 toward the bottom surface 210 of the body portion 162. As seen in FIG. 4, when vacuum is applied to the lower cavity 186, the top bag 150 on the stack of bags is engaged by the conveyor belt 178 due to the vacuum communication between the apertures 214 and the transverse apertures 246. Once the top bag 150 is engaged with the conveyor belt 178, the lifting mechanism 278 is lowered to lower the stack of bags 150 away from the bottom surface 210.

Figure 5:
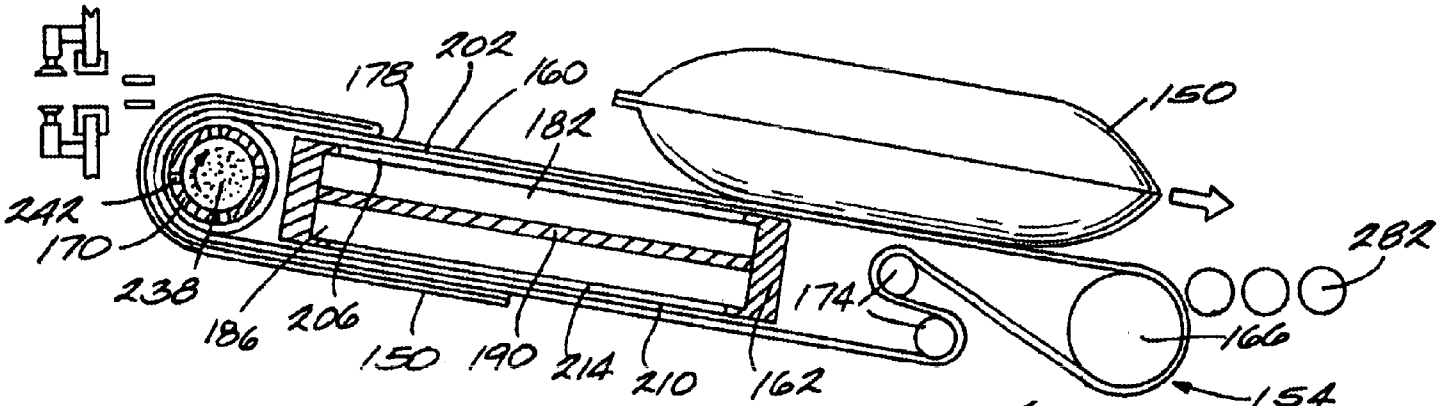

Next, the drive device 234 indexes the drive roller 166 such that the bag 150 moves with the conveyor belt 178 as shown in FIG. 5. Vacuum is applied to the follower roller 170 to hold the bag 150 in engagement with the conveyor belt 178 as the bag 150 passes over the follower roller 170. At approximately the same time, the drive device 250 drives the linkage members 254 to move the conveyor table 160 from the first position $P_H$ to the second, inclined position $P_1$. As the bag 150 approaches the top surface 202, vacuum is applied to the upper cavity 182 to maintain the engagement between the conveyor belt 178 and the bag 150. At about the same time, the vacuum is turned off in the lower cavity 186. Once the conveyor belt 178 has traveled a predetermined distance (as gauged by the programmable motor or the sensing device), and the bag 150 is on top of the conveyor table 160, the drive device 234 reverses direction to load the open end of the bag 150 into the loading station 58 as shown in FIG. 6.

FIGS. 13–20 and 21–28 illustrate (from the side and the front, respectively) the sequential operation of the bag manipulating assembly 70 and the bag welding assembly 74 once the bag 150 is loaded into the loading station 58. As seen in FIGS. 13 and 21, the bag is moved into the loading station 58 and the side edges of the bag 150 pass through the open grippers 430. The open end of the bag 150 is oriented substantially horizontally in the loading station 58 as shown. The upper and lower welding jaws 350, 326 (and therefore the upper and lower bag spreader assemblies 348, 352) are slightly opened to provide clearance for the bag 150. In this position, the cam followers 426 are positioned in or near the dwell point 394.

Figure 14:
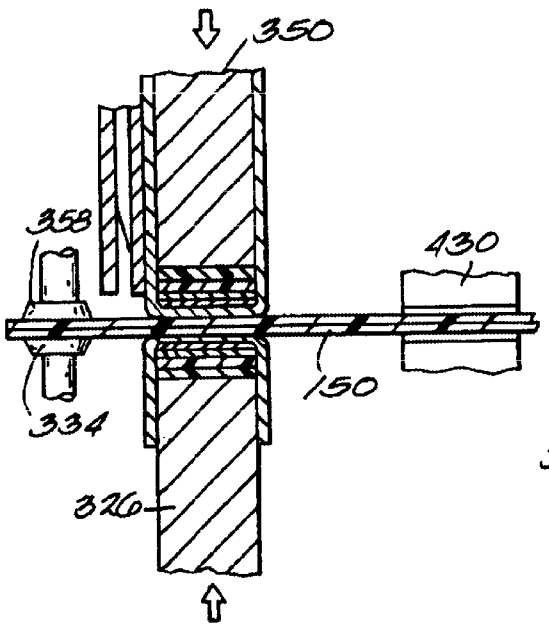
Figure 22:
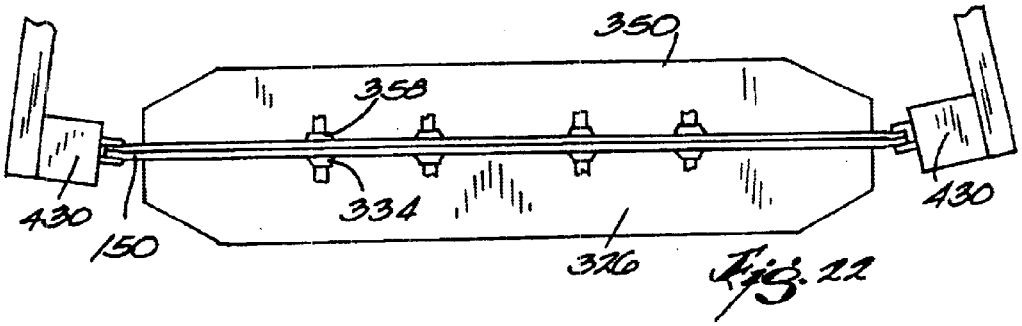

Next, as seen in FIGS. 14 and 22, the grippers 430 close, thereby securely clamping the opposing side edges of the bag 150 to maintain control over the bag 150 at all times during the packaging operation. Additionally, the welding jaws 326, 350 close so that the suction cups 334, 358 approach the open end of the bag 150 from both sides. Due to the presence of the dwell points 394, the grippers 430 do not move toward each other as the jaws 326, 350 close. Vacuum is applied to the suction cups 334, 358 so that the suction cups 334, 358 engage both sides of the open end of the bag 150.

Figure 15:
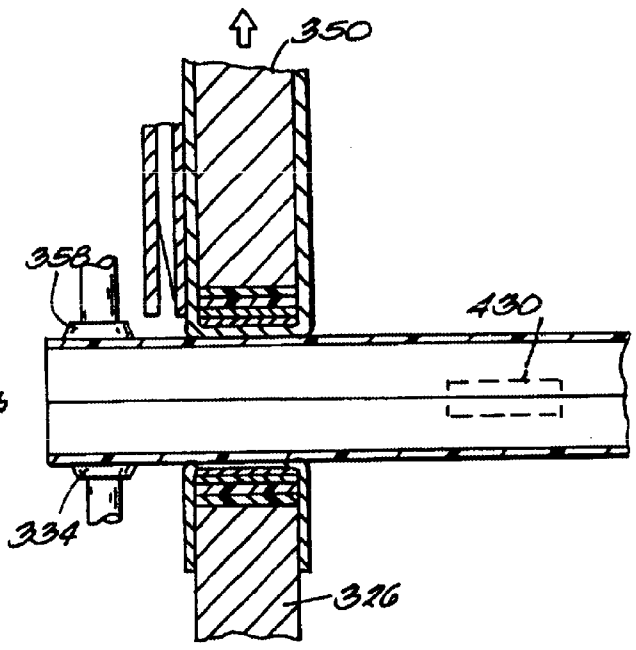
Figure 23:
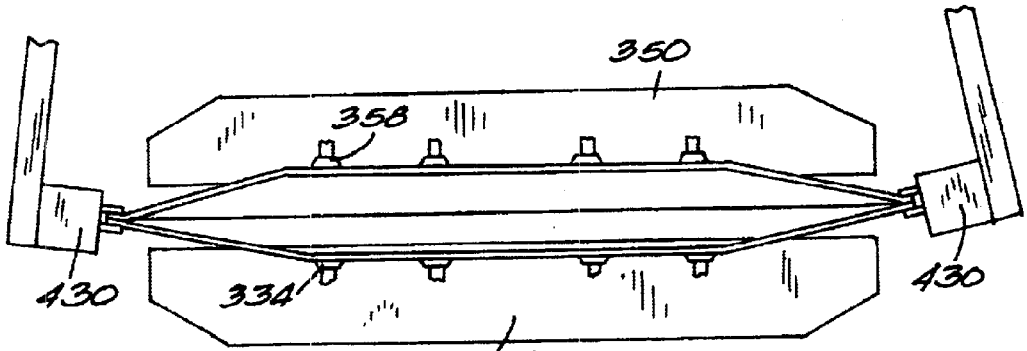

As seen in FIGS. 15 and 23, the welding jaws 326, 350 then open slightly. Because the suction cups 334, 358 have a suction grip on the top and bottom of the open end of the bag 150, the bag 150 opens slightly in response to the opening of the welding jaws 326, 350. Again, due to the dwell point 394, the grippers 430 do not move toward each other. The grippers 430 (shown schematically in FIG. 15) remain closed to keep a secure grip on the side edges of the bag 150.

Figure 16:
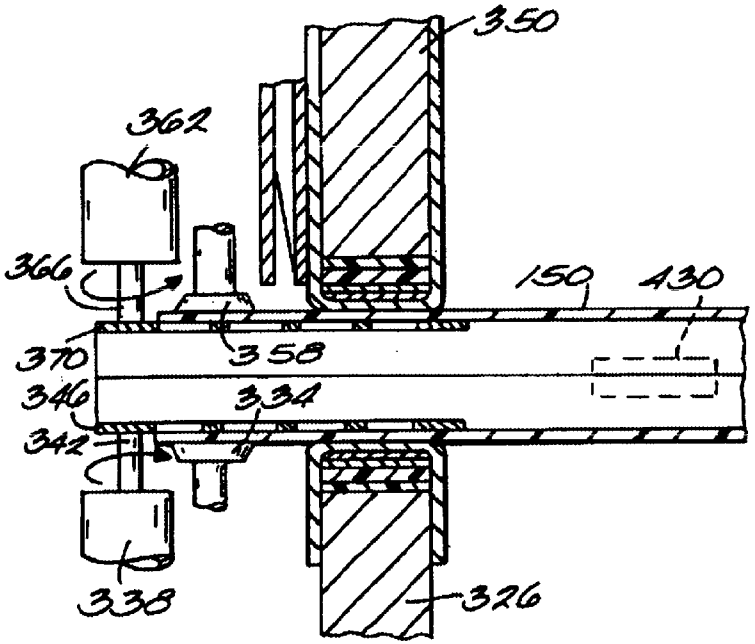
Figure 20:
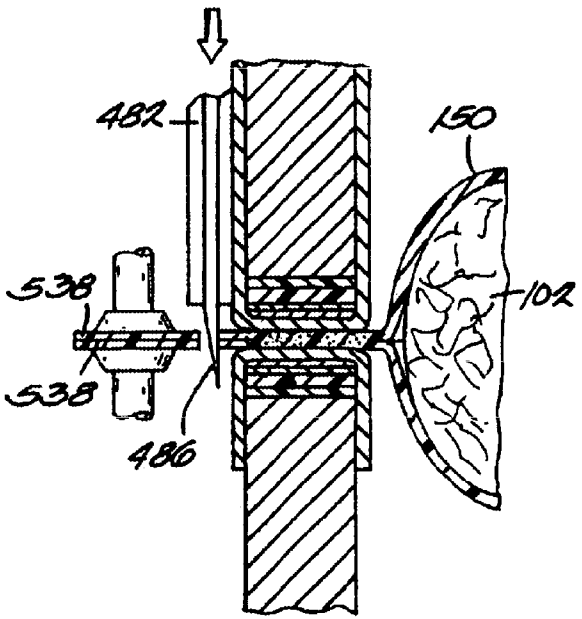

Next, as seen in FIGS. 16 and 24, the rotary actuators 338, 362 are actuated so that the spreader plates 346, 370 rotate into the open end of the bag 150. The pins 342, 366 of the rotary actuators 338, 362 also retract to draw the spreader plates 346, 370 closer to the respective suction cups 334, 358. Meanwhile, the suction is still being applied to the bag 150 by the suction cups 334, 358. The grippers 430 remain closed.

Figure 30:
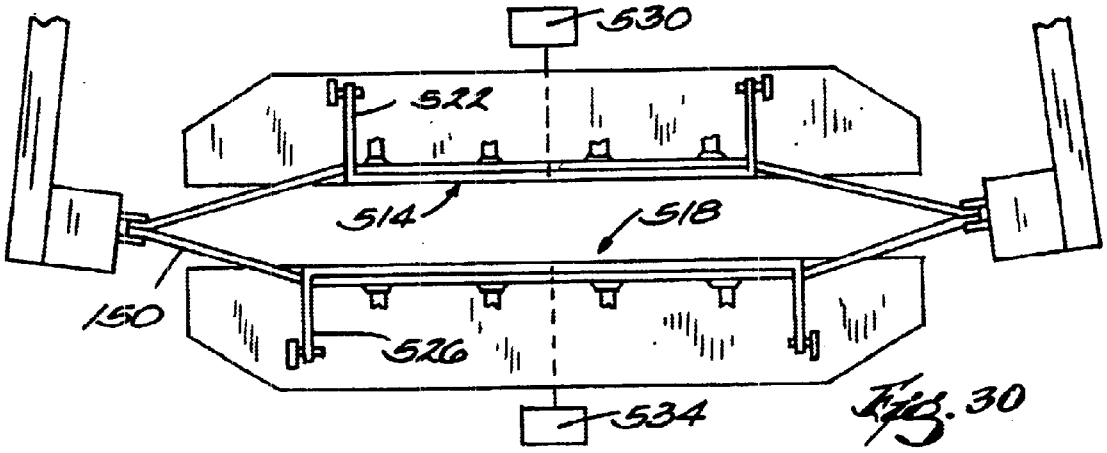
FIGS. 30–32 illustrate an alternative spreader plate arrangement for the bag manipulating assembly.
Figure 31:
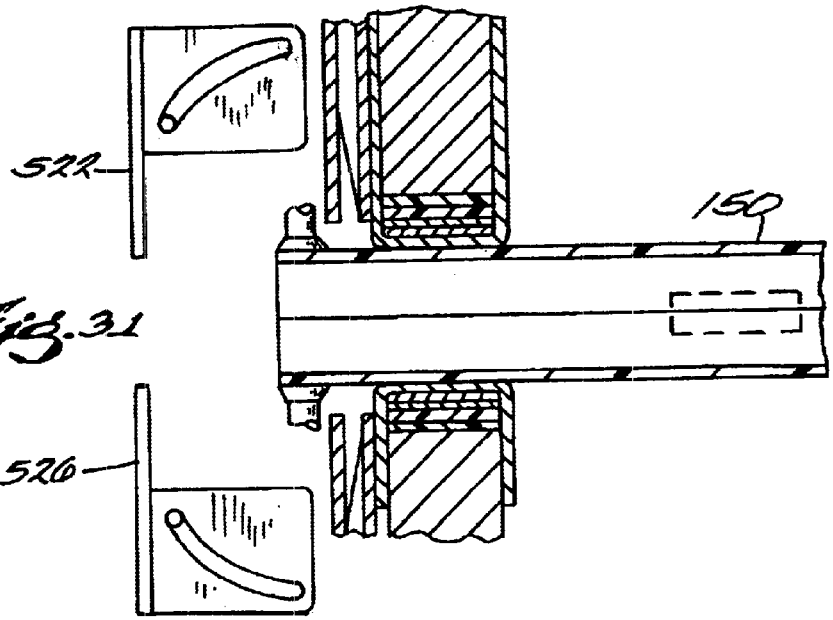
Figure 32:
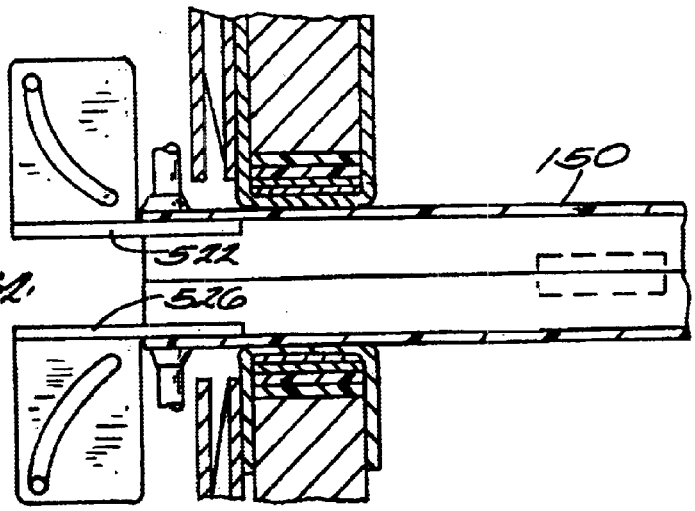

At this point, it is worth noting that other spreader plate arrangements can also be used to open the bag. FIGS. 30–32 illustrate alternative upper and lower bag spreader assemblies 514 and 518, respectively. Instead of the rotary actuators 338, 362 having the rotating and translating spreader plates 346, 370, the alternative upper and lower bag spreader assemblies 514 and 518 include respective upper and lower pivoting bag spreader plates 522 and 526. Respective actuators 530 and 534 cause the pivoting bag spreader plates 522 and 526 to pivot into and out of the open end of the bag 150 as is sequentially shown in FIGS. 31 and 32.

Returning to FIGS. 17 and 25, the welding jaws 326, 350 are opened wider so that the open end of the bag 150 is opened widely enough to receive a package 102. Both the suction cups 334, 358 and the spreader plates 346, 370 aid in opening the bag 150. As best seen in FIG. 9, when the upper welding jaw 350 is moved upwardly to open the bag 150, the gripper arms 418 pivot inwardly toward each other in response to movement of the cam members 374. The inward pivoting of the gripper arms 418 moves the grippers 430 toward each other and facilitates spreading the open end of the bag 150 apart. The grippers 430 remain closed to hold the side edges of the bag 150.

Sometime before the package 102 is pushed into the bag 150, the conveyor table 160 of the bag loading assembly 66 is returned to the first, substantially horizontal position $P_H$ (see FIGS. 1 and 4) so that the package 102 can be pushed into the bag 150 without being obstructed by the follower roller 170. Returning the conveyor table 160 to the horizontal position also prepares the bag loading assembly 66 for picking up the next bag 150 from the stack.

At this point, the bag 150 is ready to receive a package 102. The package 102 is placed on the conveyor table 106 (see FIG. 1) and the drive device 118 drives the conveyor belt 114 to move the package 102 toward the loading station 58. The pusher arms 134 are in the retracted position $P_R$ (see FIG. 1*a*) to allow the package 102 to pass by. When the sensor 142 detects the package 102, the conveyor belt 114 stops and the pusher arms 134 move to the extended position $P_E$ to overlie the conveyor table 106. The pusher arm assemblies 122 then move linearly toward the waiting package 102 so that the pushing ends 138 engage the package 102 (see FIGS. 1*b* and 10) and push the package 102 into the bag 150 (see FIGS. 18 and 26). The pusher arms 134 are then withdrawn from the bag 150 and returned to the retracted position $P_R$ in anticipation of the next packaging cycle.

Figure 19:
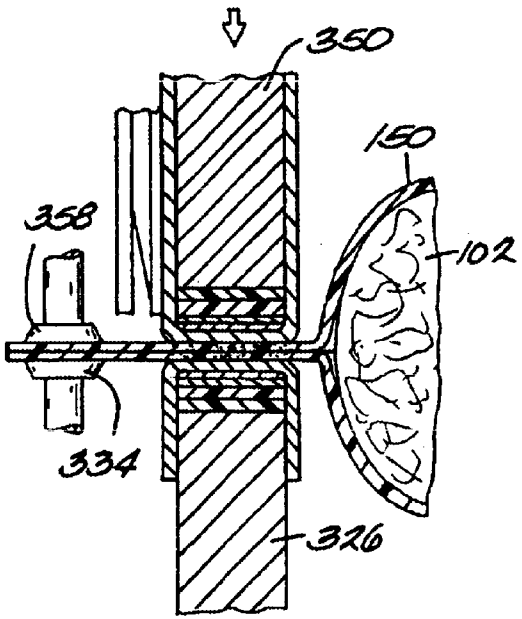
Figure 18:
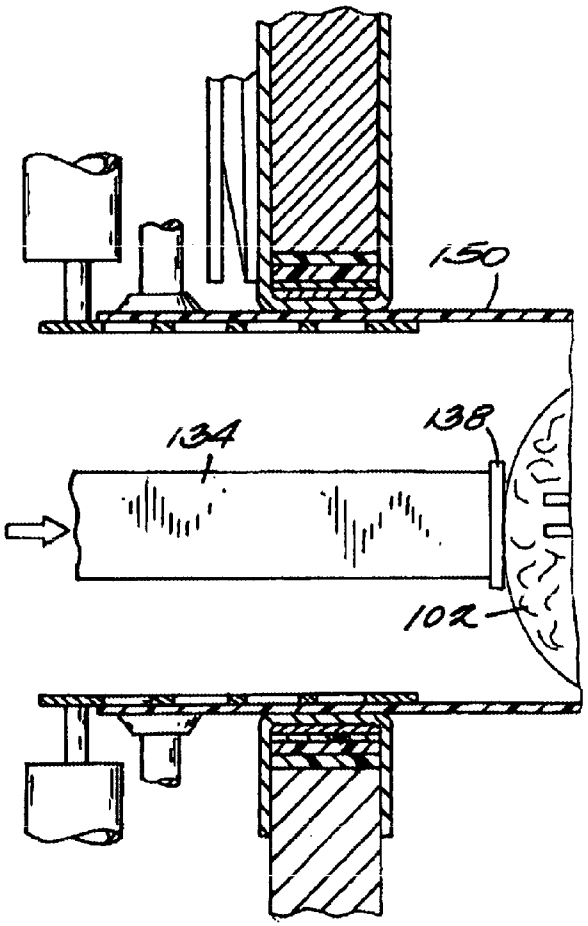
Figure 27:
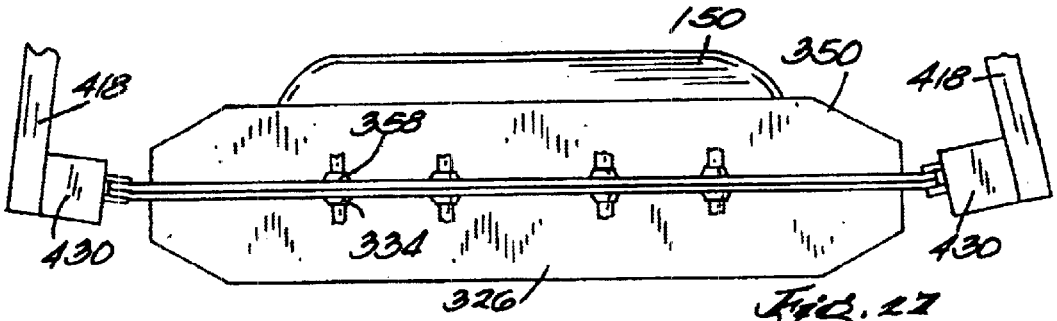

With the package 102 inside the bag 150, the bag 150 is sealed. As seen in FIGS. 19 and 27, the welding jaws 326, 350 close so that the open end of the bag 150 closes. Just prior to closing, the spreader plates 346, 370 rotate out of the bag 150. The suction is turned off at the suction cups 334, 358. As the upper welding jaw 350 moves downwardly, the gripper arms 418 pivot outwardly, away from each other. Since the grippers 430 are still closed on the side edges of the bag 150, the outward movement of the gripper arms 418 acts to stretch the bag 150, thereby helping to flatten the open end of the bag 150 in preparation for sealing.

To ensure that the open end of the bag 150 closes substantially without any wrinkling caused by the bulky package 150 inside the bag, the linear actuators 434 connected to the gripper arms 418 (see FIGS. 8 and 9) pull the gripper arms 418 even further outwardly, away from each other. This additional outward movement of the grippers 430 stretches the side edges of the bag 150 apart even further to completely flatten the open end of the bag 150 and to substantially remove any wrinkles that could cause inconsistent or incomplete sealing.

Electricity is applied to the weld wires 474 to heat seal the open end of the bag 150, as is understood. The processor 502 monitors the weld temperature, pressure, and time as described above to monitor the quality of the seal obtained.

Figure 20:
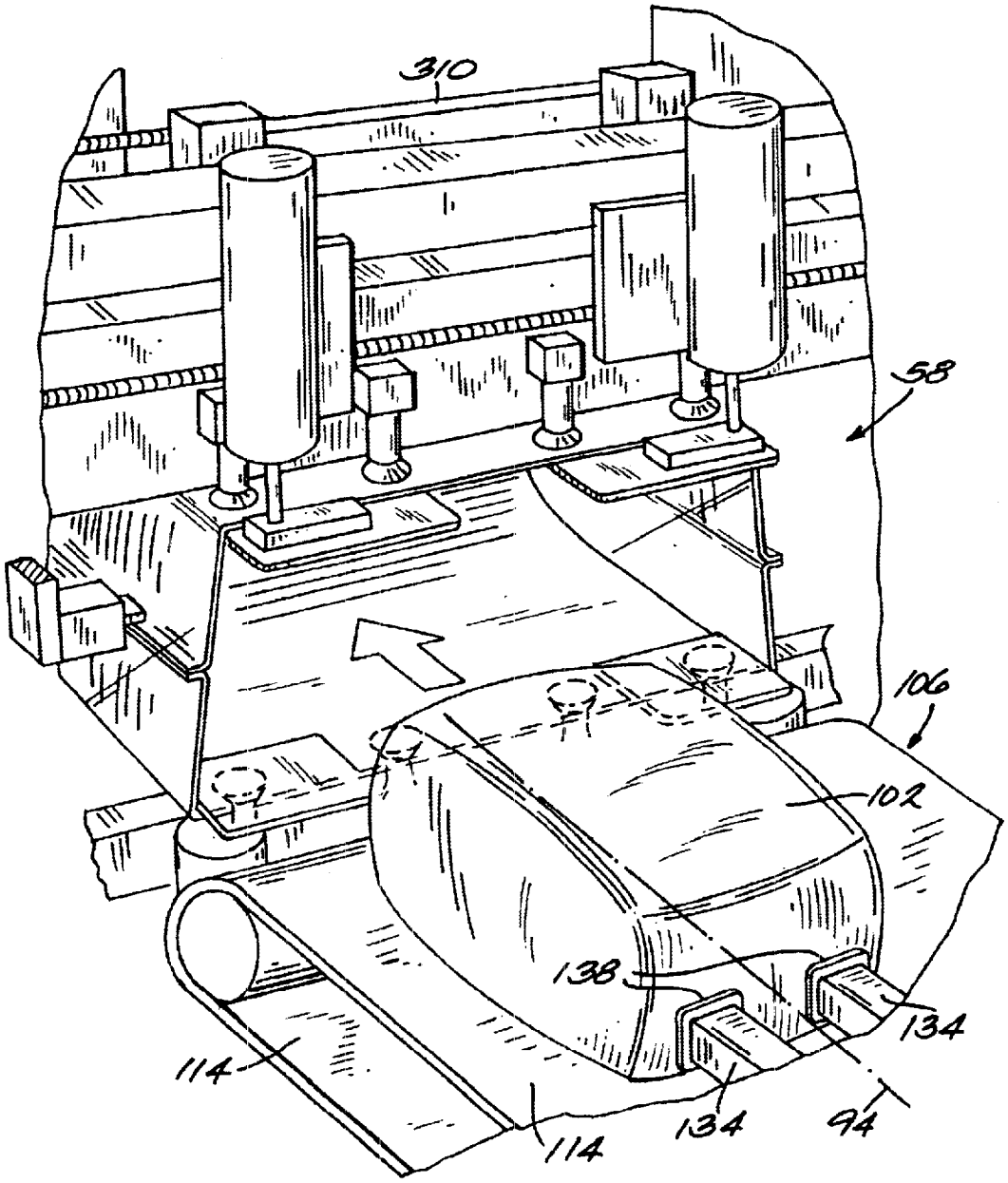
FIGS. 13–20 sequentially illustrate, in cross-section from the side, the opening, closing, and sealing of the bag.
Figure 21:
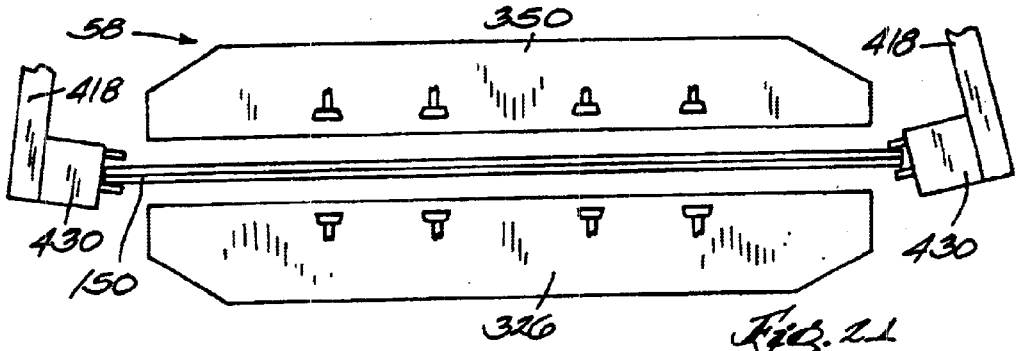
Figure 28:
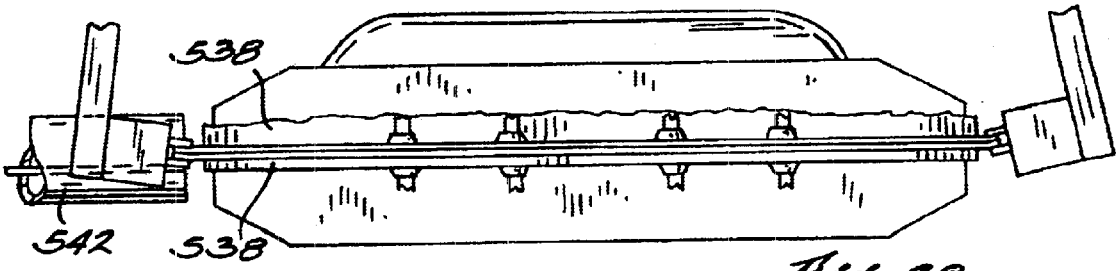

Either during, or just after welding, the cutter assembly 482 is activated to trim the bag 150 as shown in FIG. 20. As shown in FIG. 28, the trimmed bag pieces 538 are removed from the loading station 58 using a vacuum tube 542. The vacuum tube 542 is a tube positioned adjacent the loading station 58 where the trimmed bag pieces 538 are located. Vacuum supplied to the vacuum tube 542 extracts the trimmed bag pieces 538 and deposits them in a waste receptacle (not shown). Of course, other methods of removing the trimmed bag pieces 538 can be used. Alternatively, the sealed bag 150 need not be trimmed at all.

With the bag 150 packed and sealed, the grippers 430 are opened to release the side edges of the bag 150 and the conveyor belt 178 is activated to move the sealed bag 150 out of the loading station 58 and to the take-off conveyor 282 (see FIGS. 7 and 8). As seen in FIGS. 7 and 8, the next packaging cycle is underway and the next bag 150 from the stack is concurrently being engaged and moved into the loading position by the conveyor belt 178.

While not shown in the figures, the follower roller 170 can also be adapted to remove the air from inside the packed and sealed bag 150 if vacuum packing is desired. Alternatively, vacuum packing could occur at a later time on a different machine.

Figure 29:
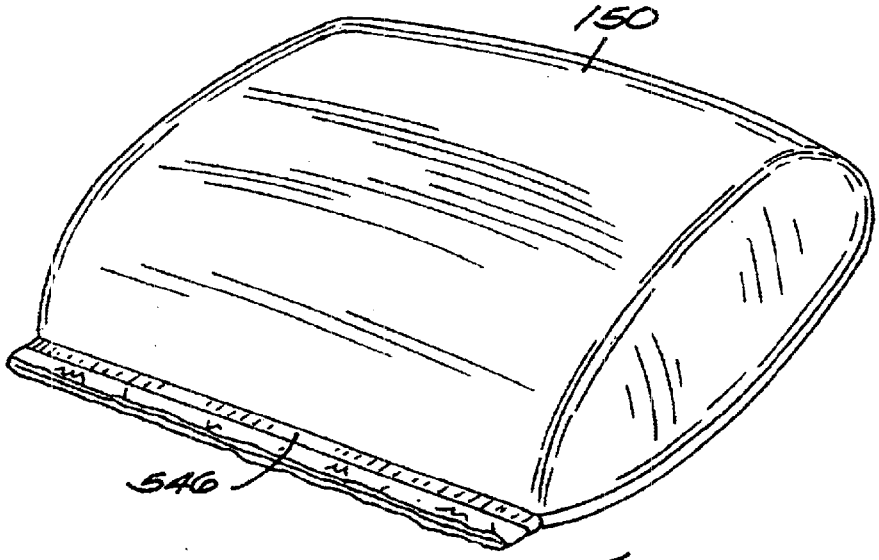
FIG. 29 is a sealed bag containing a package.

FIG. 29 illustrates a packed and sealed bag 150. The sealed area extends across the width of the bag 150 and is generally designated by the reference numeral 546.

Various features of the invention are set forth in the following claims.

What is claimed is:

1. A device for filling and sealing bags, the device comprising:

a frame;

a loading station within the frame and having a horizontal axis extending from one end of the device to another end of the device; and a bag manipulating assembly including:

a pair of bag grippers configured to receive and grip opposing side edges of a bag positioned in the loading station, the bag grippers movable in a plane substantially normal to the horizontal axis;

an upper bag spreader assembly having a suction cup to apply suction to the bag and a spreader plate that is insertable into the bag and movable to spread apart the bag; and a lower bag spreader assembly having a suction cup to apply suction to the bag and a spreader plate that is insertable into the bag and movable to spread apart the bag;

wherein each of the grippers is coupled to the frame by a respective linear actuator.

2. A device for filling and sealing bags, the device comprising:

a frame;

a loading station within the frame and having a horizontal axis extending from one end of the device to another end of the device; and a bag manipulating assembly including:

a pair of bag grippers configured to receive and grip opposing side edges of a bag positioned in the loading station, the bag grippers movable in a plane substantially normal to the horizontal axis;

an upper bag spreader assembly having a suction cup to apply suction to the bag and a spreader plate that is insertable into the bag and movable to spread apart the bag; and a lower bag spreader assembly having a suction cup to apply suction to the bag and a spreader plate that is insertable into the bag and movable to spread apart the bag;

wherein the spreader plate on the upper bag spreader assembly is rotatable into the open end of the bag.

3. The device of claim 2, wherein the upper bag spreader assembly further includes a second spreader plate that is rotatable into the open end of the bag.

4. A device for filling and sealing bags, the device comprising:

a frame;

a loading station within the frame and having a horizontal axis extending from one end of the device to another end of the device; and a bag manipulating assembly including:

a pair of bag grippers configured to receive and grip opposing side edges of a bag positioned in the loading station, the bag grippers movable in a plane substantially normal to the horizontal axis;

an upper bag spreader assembly having a suction cup to apply suction to the bag and a spreader plate that is insertable into the bag and movable to spread apart the bag; and a lower bag spreader assembly having a suction cup to apply suction to the bag and a spreader plate that is insertable into the bag and movable to spread apart the bag;

wherein the spreader plate on the upper bag spreader assembly is pivotable into the open end of the bag.

5. A bag manipulating assembly for a bag filling device, the bag manipulating assembly comprising:

a pair of bag grippers configured to receive and grip opposing side edges of a bag positioned in a loading station, the bag grippers movable in a plane substantially normal to a horizontal axis of the loading station, the horizontal axis extending from one end of the device to another end of the device;

an upper bag spreader assembly having a suction cup to apply suction to the bag and a spreader plate that is insertable into the bag and movable to spread apart the bag; and a lower bag spreader assembly having a suction cup to apply suction to the bag and a spreader plate that is insertable into the bag and movable to spread apart the bag;

wherein the spreader plates are rotatable into the bag.

6. The bag manipulating assembly of claim 5, wherein the bag grippers move toward each other in a plane substantially normal to the horizontal axis while the bag is being spread apart.

7. The bag manipulating assembly of claim 5, wherein the bag grippers move away from each other in a plane substantially normal to the horizontal axis after the bag has been filled.

8. A bag manipulating assembly for a bag filling device, the bag manipulating assembly comprising:

a pair of bag grippers configured to receive and grip opposing side edges of a bag positioned in a loading station, the bag grippers movable in a plane substantially normal to a horizontal axis of the loading station, the horizontal axis extending from one end of the device to another end of the device;

an upper bag spreader assembly having a suction cup to apply suction to the bag and a spreader plate that is insertable into the bag and movable to spread apart the bag; and a lower bag spreader assembly having a suction cup to apply suction to the bag and a spreader plate that is insertable into the bag and movable to spread apart the bag;

wherein the spreader plates are pivotable into the bag.

9. The bag manipulating assembly of claim 8, wherein the bag grippers move toward each other in a plane substantially normal to the horizontal axis while the bag is being spread apart.

10. The bag manipulating assembly of claim 8, wherein the bag grippers move away from each other in a plane substantially normal to the horizontal axis after the bag has been filled.

* * * * *